US011098850B2

(12) United States Patent
Ramoo et al.

(10) Patent No.: US 11,098,850 B2
(45) **Date of Patent: *Aug. 24, 2021**

(54) STORAGE TANK CONTAINMENT SYSTEM

(71) Applicant: Altair Engineering, Inc., Troy, MI (US)

(72) Inventors: Regu Ramoo, Ashburn, VA (US); Thomas Lamb, Lynnwood, WA (US)

(73) Assignee: Altair Engineering, Inc., Troy, MI (US)

( * ) Notice: Subject to any disclaimer, the term of this patent is extended or adjusted under 35 U.S.C. 154(b) by 197 days.

This patent is subject to a terminal disclaimer.

(21) Appl. No.: 16/507,531

(22) Filed: Jul. 10, 2019

(65) Prior Publication Data

US 2019/0331296 A1 Oct. 31, 2019

Related U.S. Application Data

(63) Continuation of application No. 15/204,387, filed on Jul. 7, 2016, now Pat. No. 10,352,500, which is a (Continued)

(51) Int. Cl.
*F17C 1/02* (2006.01)
*F17C 1/00* (2006.01)

(Continued)

(52) U.S. Cl.
CPC ..... *F17C 1/002* (2013.01); *B65D 90/02* (2013.01); *B65D 90/08* (2013.01); *F17C 3/00* (2013.01);

(Continued)

(58) Field of Classification Search
CPC ..... F17C 2201/0152; F17C 2260/016; F17C 1/002; F17C 2201/0166; F17C 2223/0161;

(Continued)

(56) References Cited

U.S. PATENT DOCUMENTS 965,455 A 7/1910 Harry
1,769,831 A 7/1930 Gramm (Continued)

FOREIGN PATENT DOCUMENTS

CN 2299219 12/1998
CN 201023882 2/2008

(Continued)

OTHER PUBLICATIONS

JP Office Action in Japanese Appln. No. 2018-519697, dated Sep. 20, 2019, 4 pages (with English translation).

(Continued)

*Primary Examiner* — Stephen J Castellano
(74) *Attorney, Agent, or Firm* — Fish & Richardson P.C.

(57) ABSTRACT

A large volume natural gas storage tank comprises rigid tubular walls having closed tubular cross-sections that are interconnected at opposing ends with two other rigid tubular walls such that interiors of the rigid tubular walls define an interior fluid storage chamber. The storage tank also includes bulkheads positioned in the interior fluid storage chamber across intermediate segments of the rigid tubular walls and closure plates connected between exterior surfaces of successive interconnected rigid tubular walls to define sides of the storage tank. Interior surfaces of the closure plates and exterior surfaces of the rigid tubular walls define an auxiliary fluid storage chamber. The storage tank also includes exterior support structures extending through the closure plates and between the exterior surfaces of the rigid tubular walls on some of the sides of the storage tank to reinforce the storage tank against dynamic loading from fluid in the interior fluid storage chamber.

14 Claims, 27 Drawing Sheets

Related U.S. Application Data continuation-in-part of application No. 14/923,015, filed on Oct. 26, 2015, now Pat. No. 9,708,120, which is a continuation-in-part of application No. 14/506,909, filed on Oct. 6, 2014, now Pat. No. 9,321,588, which is a continuation of application No. 13/681,764, filed on Nov. 20, 2012, now Pat. No. 8,851,321, and a continuation-in-part of application No. 12/823,719, filed on Jun. 25, 2010, now Pat. No. 8,322,551, which is a continuation-in-part of application No. 11/923,787, filed on Oct. 25, 2007, now abandoned.

(60) Provisional application No. 61/562,213, filed on Nov. 21, 2011, provisional application No. 60/854,593, filed on Oct. 26, 2006.

(51) Int. Cl.
*B65D 90/08* (2006.01)
*F17C 3/00* (2006.01)
*B65D 90/02* (2019.01)

(52) U.S. Cl.
CPC ..... *F17C 2201/0152* (2013.01); *F17C 2201/0166* (2013.01); *F17C 2201/052* (2013.01); *F17C 2203/012* (2013.01); *F17C 2203/0646* (2013.01); *F17C 2203/0648* (2013.01); *F17C 2209/221* (2013.01); *F17C 2221/033* (2013.01); *F17C 2223/0161* (2013.01); *F17C 2260/016* (2013.01); *F17C 2270/0102* (2013.01); *F17C 2270/0105* (2013.01)

(58) Field of Classification Search
CPC ..... F17C 2203/012; F17C 2270/0102; F17C 2270/0105; F17C 2201/052; F17C 2201/0157; B65D 90/52; B65D 90/08
See application file for complete search history.

(56) References Cited

U.S. PATENT DOCUMENTS

| | | | | |
|---|---|---|---|---|
| 2,593,408 | A | 4/1952 | Boardman | |
| 2,673,001 | A | 3/1954 | Ulm et al. | |
| 2,675,940 | A | 4/1954 | Ewald | |
| 3,088,622 | A | 5/1963 | Ulm et al. | |
| 3,124,265 | A | 3/1964 | Bertels | |
| 3,314,567 | A | 4/1967 | Becker et al. | |
| 3,414,153 | A | 12/1968 | Leroux | |
| 3,612,329 | A | 10/1971 | Parks et al. | |
| 3,912,103 | A | 10/1975 | Gerhard | |
| 3,944,106 | A | 3/1976 | Lamb | |
| 4,459,929 | A | 7/1984 | Ffooks | |
| 4,838,449 | A | 6/1989 | Jarnott et al. | |
| 4,946,056 | A | 8/1990 | Stannard | |
| 4,947,988 | A | 8/1990 | Schutz | |
| 4,947,998 | A | 8/1990 | Smeller | |
| 5,462,505 | A | 10/1995 | Blair et al. | |
| 5,624,049 | A | 4/1997 | Kovash et al. | |
| 6,095,367 | A | 8/2000 | Blair et al. | |
| 6,354,457 | B1 | 3/2002 | Aaron | |
| 6,659,303 | B2 | 12/2003 | Garceau | |
| 6,691,889 | B1 | 2/2004 | Falk | |
| 6,971,537 | B2 | 12/2005 | Enright, Jr. | |
| 6,994,104 | B2 | 2/2006 | Bishop et al. | |
| RE41,142 | E | 2/2010 | Blair et al. | |
| 8,020,722 | B2 | 9/2011 | Richards et al. | |
| 8,322,551 | B2 * | 12/2012 | Ramoo | B65D 7/02 220/4.12 |
| 8,851,320 | B2 | 10/2014 | Ramoo et al. | |
| 8,851,321 | B2 * | 10/2014 | Ramoo | F17C 3/00 220/592 |
| 9,175,806 | B2 | 11/2015 | Ramoo et al. | |
| 9,321,588 | B2 * | 4/2016 | Ramoo | B65D 90/12 |
| 9,708,120 | B2 | 7/2017 | Ramoo et al. | |
| 1,035,250 | A1 | 7/2019 | Ramoo et al. | |
| 10,876,686 | B2 | 12/2020 | Ramoo et al. | |
| 2001/0040160 | A1 | 11/2001 | Gulati | |
| 2008/0099489 | A1 | 5/2008 | Ramoo et al. | |
| 2008/0209918 | A1 | 9/2008 | White | |
| 2010/0083671 | A1 | 4/2010 | Liner | |
| 2010/0258571 | A1 | 10/2010 | Ramoo et al. | |
| 2011/0121003 | A1 | 5/2011 | Moir | |
| 2014/0137782 | A1 | 5/2014 | Cho et al. | |
| 2014/0224169 | A1 | 8/2014 | Morimoto | |
| 2015/0021318 | A1 | 1/2015 | Ramoo et al. | |
| 2015/0021341 | A1 | 1/2015 | Ramoo et al. | |
| 2016/0040829 | A1 | 2/2016 | Ramoo et al. | |
| 2016/0319990 | A1 | 11/2016 | Ramoo et al. | |
| 2019/0063682 | A1 | 2/2019 | Ramoo et al. | |

FOREIGN PATENT DOCUMENTS

| | | | |
|---|---|---|---|
| CN | 101321662 | | 12/2008 |
| CN | 201411172 | | 2/2010 |
| CN | 101668677 | | 3/2010 |
| CN | 104011453 | A | 8/2014 |
| CN | 106870928 | | 6/2017 |
| CN | 108349576 | A | 7/2018 |
| JP | S 45-023777 | B | 8/1970 |
| JP | S 48-028020 | | 5/1973 |
| JP | S49-129290 | U | 11/1974 |
| JP | H08-133384 | A | 5/1996 |
| JP | 2004-106942 | A | 4/2004 |
| JP | 2004106942 | A | 4/2004 |
| JP | 2005-521834 | | 7/2005 |
| JP | 2015-502301 | | 1/2015 |
| JP | 6096796 | B2 | 3/2017 |
| KR | 10-1998-0701861 | | 6/1998 |
| KR | 10-2009-0032087 | | 3/2009 |
| KR | 10-2009-0074045 | | 7/2009 |
| KR | 10-2009-0132225 | | 12/2009 |
| KR | 10-2013-0000472 | | 1/2013 |
| KR | 20140098175 | A | 8/2014 |
| WO | WO 1984/001553 | | 4/1984 |
| WO | WO 2006/001711 | | 1/2006 |
| WO | WO 2008/052149 | | 5/2008 |
| WO | WO 2013/024835 | | 2/2013 |
| WO | WO2013/078210 | A1 | 5/2013 |
| WO | WO 2015/068383 | | 5/2015 |
| WO | WO2017074313 | A1 | 5/2017 |
| WO | WO2017074538 | A1 | 5/2017 |

OTHER PUBLICATIONS

JP Office Action in JP Appln. No. 2018-519697, dated Jan. 6, 2020, 2 pages (English translation only).
PCT International Preliminary Report on Patentability in International Appln. No. PCT/US2018/048706, dated Mar. 12, 2020, 7 pages.
JP Office Action in Japanese Appln. No. 2018-519696, dated Jan. 5, 2021, 7 pages (with English Translation).
CN Office Action for CN App No. 201280064580 dated May 15, 2015 (with English translation) (10 pages).
International Preliminary Report on Patentability for Int. App No. PCT/US2012/066073 dated May. 27, 2014 (5 pages).
International Preliminary Report on Patentability for Int. App No. PCT/US2016/047382 dated May. 1, 2018 (11 pages).
International Preliminary Report on Patentability for Intl App No. PCT/US2015/057583, dated May. 1, 2018 (7 pages).
International Search and Written Opinion for Intl App No. PCT/US2016/047382 dated Nov. 3, 2016 (12 pages).
International Search Report and Written Opinion for Int. App No. PCT/US2012/066073 dated Mar. 26, 2013 (8 pages).
International Search Report and Written Opinion for Intl App No. PCT/US2015/057583, dated Jul. 14, 2016 (9 pages).
International Search Report and Written Opinion for Intl App No. PCT/US2018/048706, dated Oct. 30, 2018 (13 pages).

(56) References Cited

OTHER PUBLICATIONS

JP Office Action for JP App No. 2014-542571 dated Jun. 30, 2016 (with English translation) (5 pages).
KR Office Action for KR App No. 10-2014-7017198 dated May 9, 2018 (with English translation) (5 pages).
CN Office Action for CN App. No. 201680062642, dated Aug. 14, 2019, 4 pages.
JP Office Action for Japanese Appln. No. 2018-519696, dated Sep. 1, 2020, 13 pages (with English Translation).
CN Office Action in Chinese Appln. No. 111279115A, dated Mar. 19, 2021, 24 pages.
Xiao-zhong, "Development status of LNG tank and its applicability for marine," Liaoning Chemical Industry, Jan. 2014, 43(1): 3 pages (with English Abstract).

* cited by examiner

STORAGE TANK CONTAINMENT SYSTEM

CROSS REFERENCE TO RELATED APPLICATIONS

This continuation application claims priority benefit to U.S. Utility patent application Ser. No. 15/204,387 filed Jul. 7, 2016, now U.S. Pat. No. 10,352,500 issued on Jul. 16, 2019, which is a continuation-in-part application claiming priority benefit to U.S. Utility patent application Ser. No. 14/923,015 filed Oct. 26, 2015, now U.S. Pat. No. 9,708,120 issued on Jul. 18, 2017, which is a continuation-in-part application claiming priority benefit to U.S. Utility patent application Ser. No. 14/506,909 filed Oct. 6, 2014, now U.S. Pat. No. 9,321,588 issued on Apr. 26, 2016, which is a continuation claiming priority benefit to U.S. Utility patent application Ser. No. 13/681,764 filed Nov. 20, 2012, now U.S. Pat. No. 8,851,321 issued on Oct. 7, 2014, which claims priority benefit to U.S. provisional patent application Ser. No. 61/562,213 filed Nov. 21, 2011, and which is a continuation-in-part application claiming priority benefit to U.S. Utility patent application Ser. No. 12/823,719 filed Jun. 25, 2010, now U.S. Pat. No. 8,322,551 issued on Dec. 4, 2012, which is a continuation-in-part application claiming priority benefit to U.S. Utility patent application Ser. No. 11/923,787 filed Oct. 25, 2007, abandoned, which claims priority benefit to U.S. provisional patent application Ser. No. 60/854,593 filed on Oct. 26, 2006, all of which are incorporated herein by reference in their entireties.

FIELD OF THE INVENTION

The embodiments disclosed herein generally pertain to storage tanks and more particularly to storage tanks for fluids including liquids and gases.

BACKGROUND

Industrial storage tanks used to contain fluids such as liquids or compressed gases are common and are vital to industry. Storage tanks may be used to temporarily or permanently store fluids at an on-site location, or may be used to transport fluids over land or sea. Numerous inventions pertaining to the structural configurations of fluid storage tanks have been made over the years. One example of a non-conventional fluid storage tank having a cube-shaped configuration is found in U.S. Pat. No. 3,944,106 to Thomas Lamb, the entire contents of which is incorporated herein by reference.

There has been a progressive demand for the efficient storage and long distance transportation of fluids such as liquid natural gas (LNG), particularly overseas by large ocean-going tankers or carriers. In an effort to transport fluid such as LNG more economically, the holding or storage capacity of such LNG carriers has increased significantly from about 26,000 cubic meters in 1965 to over 200,000 cubic meters in 2005. Naturally, the length, beam and draft of these super carriers have also increased to accommodate the larger cargo capacity. The ability to further increase the size of these super carriers, however, has practical limits.

Difficulties have been experienced in the storage and transportation of fluids, particularly in a liquid form, by ocean carriers. A trend for large LNG carriers has been to use large side-to-side membrane-type tanks and insulation box supported-type tanks. As the volume of the tank transporting the fluid increases, the hydrostatic and dynamic loads on the tank containment walls increase significantly. These membrane and insulation types of tanks suffer from the disadvantage of managing the "sloshing," movement of the liquid in the tank due to the natural movement of the carrier through the sea. As a result, the effective holding capacity of these types of tanks has been limited to either over 80% full or less than 10% full to avoid damage to the tank lining and insulation. The disadvantages and limitations of these tanks are expected to increase as the size of carriers increase.

The prior U.S. Pat. No. 3,944,106 tank was evaluated for containment of LNG in large capacities, for example, in large LNG ocean carriers against a similarly sized geometric cube tank. It was determined that the '106 tank was more rigid using one third the wall thickness of the geometric cube. The '106 tank further significantly reduced the velocity of the fluid, reduced the energy transmitted to the tank and reduced the forces transmitted by the fluid to the tank, resulting in substantially less deformation of the tank compared to the geometric cubic tank. It was further determined, however, that the '106 configured tank could be improved.

Additional cubic-shaped tank designs have been developed for LNG and compressed natural gas (CNG). Details of these tanks can be found in US Patent Application Publication Nos. 2008/0099489 and 2010/0258571 assigned to the assignee of the present invention, the entire contents of both publications are incorporated herein by reference.

Therefore, it would be advantageous to design and fabricate storage tanks for the efficient storage and transportation of large quantities of fluids such as LNG across land or sea. It is further desirable to provide a storage tank that is capable of being fabricated in ship yards for large LNG Carriers. It is further advantageous to provide a modular-type tank design which facilitates design, fabrication and use in the field.

SUMMARY

Disclosed herein are embodiments of a large volume natural gas storage tank.

In one aspect, a large volume natural gas storage tank comprises rigid tubular walls having opposing ends and intermediate segments with closed tubular cross-sections and interconnected at both ends with respective ends of two other rigid tubular walls such that interconnected interiors of the rigid tubular walls define an interior fluid storage chamber; bulkheads positioned in the interior fluid storage chamber across the intermediate segments of the rigid tubular walls; closure plates connected between exterior surfaces of successive interconnected rigid tubular walls to define sides of the storage tank, wherein interior surfaces of the closure plates and the exterior surfaces of the rigid tubular walls define an auxiliary fluid storage chamber; and exterior support structures extending through the closure plates and between the exterior surfaces of the successive interconnected rigid tubular walls on at least some of the sides of the storage tank configured to reinforce the storage tank against dynamic loading from fluid in the interior fluid storage chamber.

In another aspect, a large volume natural gas storage tank comprises rigid tubular walls having opposing ends and intermediate segments with closed tubular cross-sections and interconnected at both ends with respective ends of two other rigid tubular walls such that interconnected interiors of the rigid tubular walls define an interior fluid storage chamber; bulkheads positioned in the interior fluid storage chamber across the intermediate segments of the rigid tubular walls, each bulkhead comprising an annular planar plate connected with an interior of one of the rigid tubular walls and defining an aperture to permit a restricted flow of fluid through the bulkhead; closure plates connected between exterior surfaces of successive interconnected rigid tubular walls to define sides of the storage tank, wherein interior surfaces of the closure plates and the exterior surfaces of the rigid tubular walls define an auxiliary fluid storage chamber; and exterior support structures extending from the closure plates, through the exterior surfaces of the successive interconnected rigid tubular walls, to the bulkheads on at least some of the sides of the storage tank, the exterior support structures configured to reinforce the storage tank against dynamic loading from fluid in the interior fluid storage chamber.

In yet another aspect, a large volume natural gas storage tank comprises rigid tubular walls having opposing ends and intermediate segments with closed tubular cross-sections and interconnected at both ends with respective ends of two other rigid tubular walls such that interconnected interiors of the rigid tubular walls define an interior fluid storage chamber; bulkhead ring webs positioned in the interior fluid storage chamber across the intermediate segments of the rigid tubular walls, each bulkhead ring web comprising an annular planar plate connected with an interior of one of the rigid tubular walls and defining an aperture to permit a restricted flow of fluid through the bulkhead ring web; closure plates extending normally between exterior surfaces of successive interconnected rigid tubular walls to define vertical sides of the storage tank, herein interior surfaces of the closure plates and the exterior surfaces of the rigid tubular walls at least partially define an auxiliary fluid storage chamber; exterior support structures comprising rigidly interconnected vertical and horizontal braces, the braces extending between the exterior surfaces of the successive interconnected rigid tubular walls and outward through the closure plates on the vertical sides of the storage tank; and blocks disposed on the braces outward of the exterior surfaces of the closure plates on the vertical sides of the tank, the blocks configured to maintain the storage tank in an installation position when abutting brackets extending from a cargo hold of a carrier.

These and other aspects will be described in additional detail below. Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
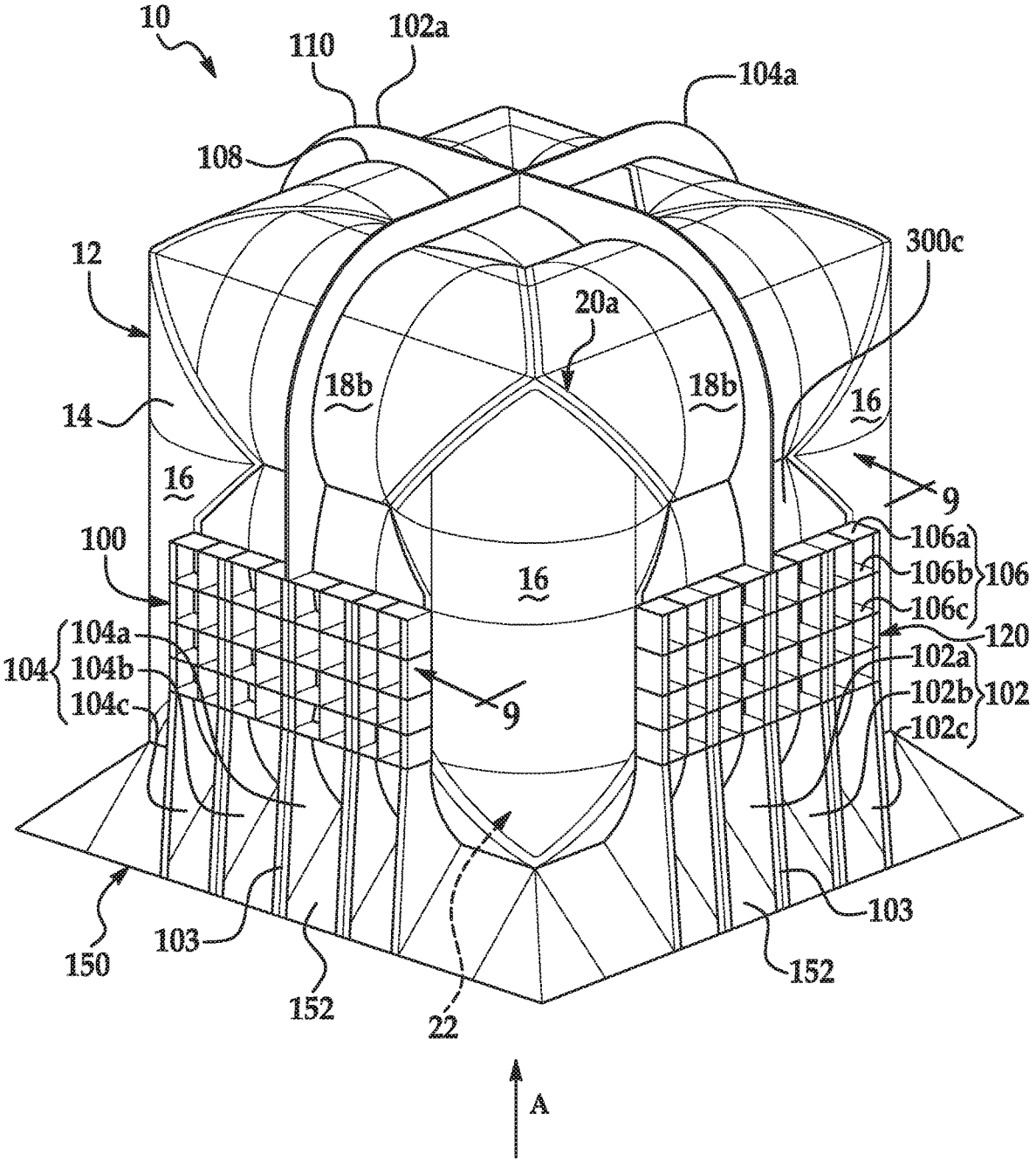
FIG. 1 is a perspective view of a first example of a storage tank containment system having a storage tank and a storage tank support structure.
Figure 2:
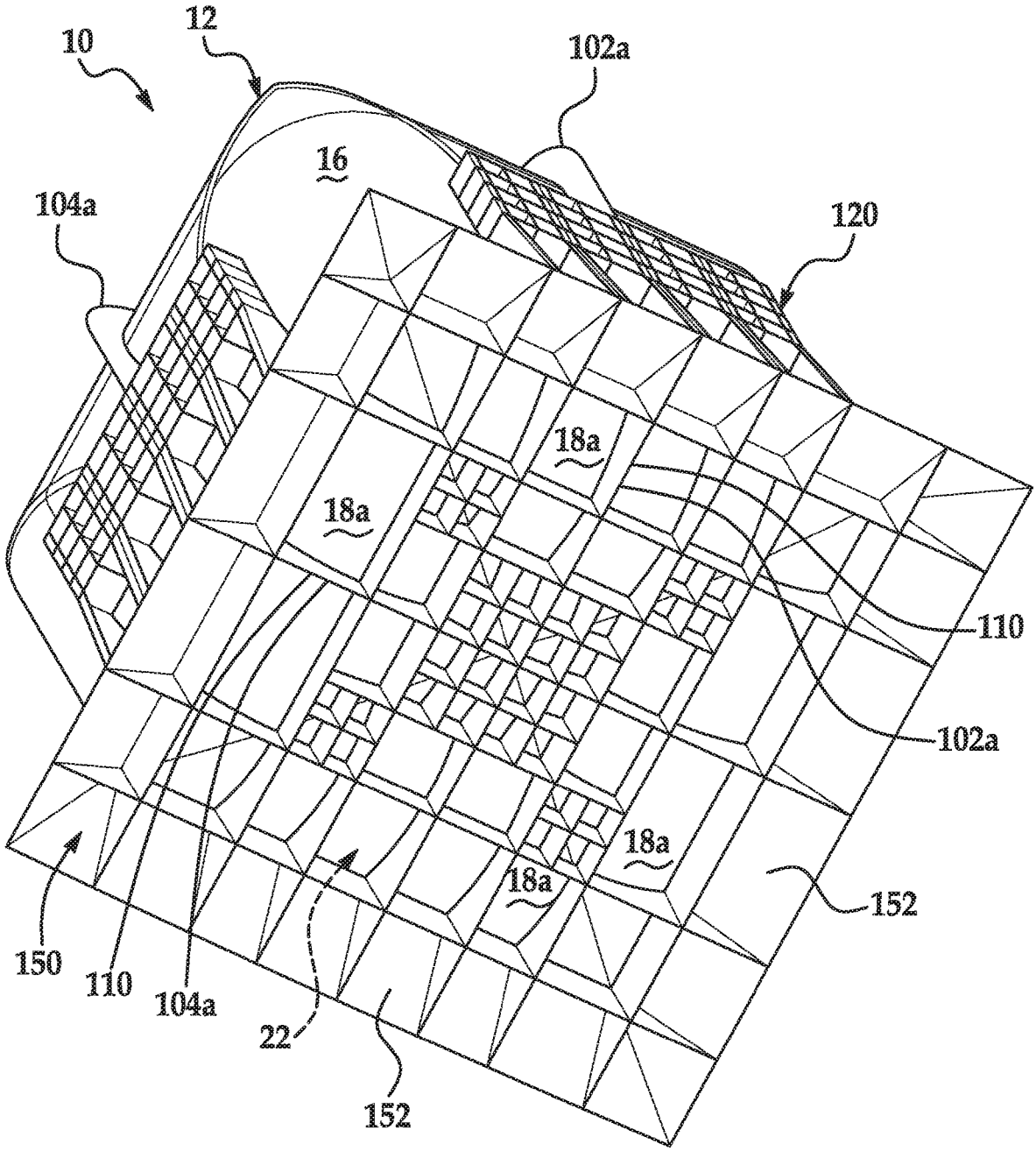
FIG. 2 is a perspective view of the bottom side of the storage tank containment system of FIG. 1 as viewed from the direction of A in FIG. 1.

Examples of storage tank containment systems 10 are shown in FIGS. 1-27. A first example of a storage tank containment system 10 is shown in FIGS. 1-10. Referring to FIGS. 1-3, the first example of a storage tank containment system 10 includes a storage tank 12 having a generally cubic configuration, with six geometric square sides oriented at substantially right angles with respect to one another. The tank 12 is preferably constructed from twelve interconnected hollow or tubular walls (a single exemplary cylindrical-shaped wall 14 indicated in FIG. 1). Though in the following examples, the interconnected tubular walls are cylindrically-shaped and have a closed, substantially circular cross-section, other hollow or tubular shapes are also possible.

The exemplary storage tank 12 includes four vertically oriented cylinder walls 16 positioned approximately 90 degrees apart from one another and eight horizontally oriented cylinder walls 18 disposed between, and rigidly connecting to, the ends of the vertical walls 16 at corner portions 20*a*. As shown, the eight horizontal cylinder walls 18 include four lower cylinder walls 18*a* arranged at a bottom of the storage tank 12 and four upper cylinder walls 18*b* arranged at a top of the storage tank 12. In a preferred example, each of the vertical walls 16 and horizontal walls 18 can be the same length with substantially identical cross-sections and curvatures.

The interconnected hollow cylinder walls 14 define an interior fluid storage chamber 22 suitable for containment of materials including fluids, for example liquid natural gas (LNG), maintained at or above atmospheric pressure. Other fluids, such as gasses, known by those skilled in the art may be stored or contained by tank 12. Although described and illustrated as a cube with all six sides having equal dimensions, it is understood that the storage tank 12 can take different geometric configurations, for example, rectangular having longer horizontal dimensions and smaller vertical dimensions. Other shapes and configurations known by those skilled in the art may be used.

Figure 4:
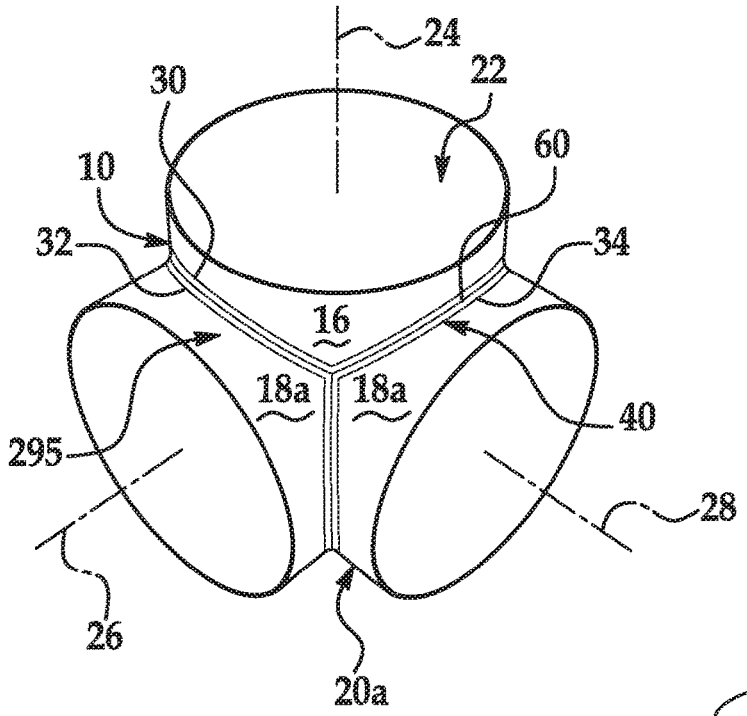
FIG. 4 is a rear partial perspective view of an example of a corner portion of the storage tank as viewed from an interior space of the storage tank.
Figure 5A:
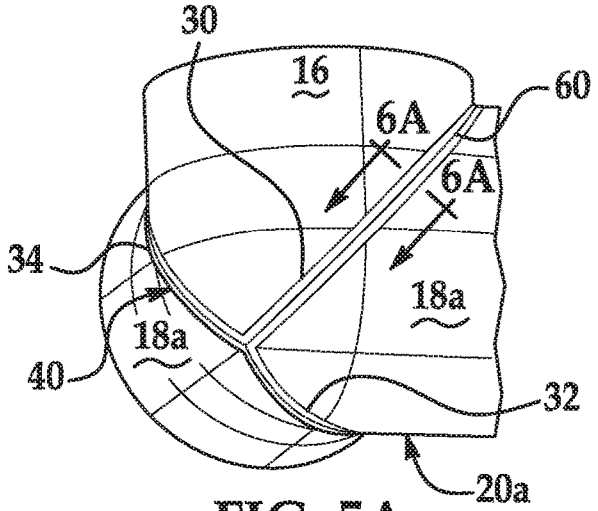
FIG. 5A is a rear partial perspective view of the example corner portion of FIG. 4 as viewed from an interior space of the storage tank.

FIG. 4 shows the example corner portion 20*a* as viewed from an interior space 295 (best seen in FIG. 9) of the storage tank 12, and FIG. 5A shows the corner portion 20*a* as viewed from the exterior of the storage tank 12. In the example, the corner portion 20*a* is disposed adjacent each opposing end of the four vertical cylinder walls 16 for a total of eight corner portions 20*a* forming the eight corners of the exemplary cubic storage tank 12. In the example, a vertical cylinder wall 16 connects to two lower horizontal cylinder walls 18*a*. The vertical cylinder wall 16 extends along a substantially vertical longitudinal axis 24, and the two horizontal cylinder walls 18*a* each extend along an axis 26 and 28, respectively, at substantially right angles to the axis 24. The axes 26 and 28 extend at a substantially right angle with respect to one another in a plane orthogonal to the axis 24, such that the horizontal cylinder walls 18*a* are positioned in a substantially horizontal orientation.

The axes 24, 26 and 28 intersect at a point (not shown) inside the corner portion 20*a*. As generally shown, the vertical cylinder wall 16 and the two horizontal cylinder walls 18*a* extend along their respective axes and are generally connected at their respective distal ends 30, 32 and 34 at a joint 40 between the respective cylinder walls, closing off the interior fluid storage chamber 22. The joint 40 includes a closure member 60 positioned to close a space or gap between the respective distal ends 30, 32 and 34 of the vertical cylinder wall 16 and the two horizontal cylinder walls 18*a*, as explained below, although other configurations for the joint 40 are possible.

Figure 5B:
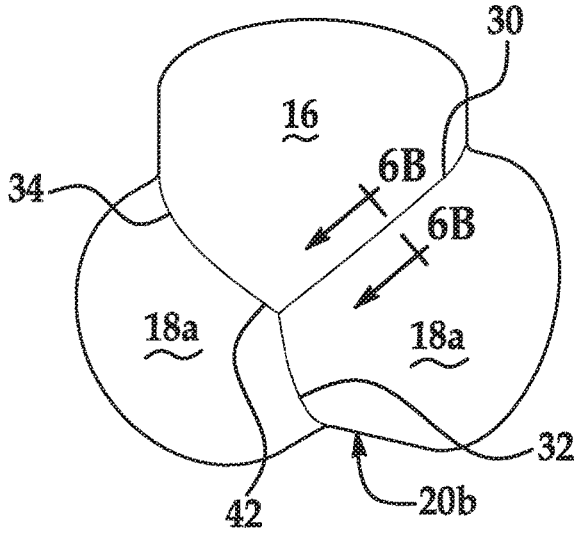
FIGS. 5B and 5C are rear partial perspective views of alternate examples of corner portions as viewed from an interior space of the storage tank.
Figure 5C:
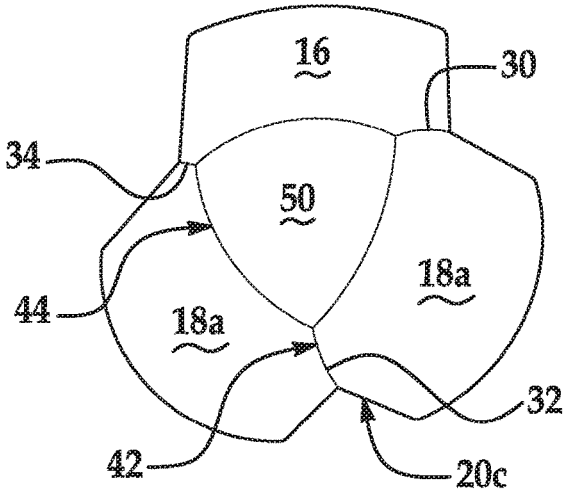

In the alternative example of a corner portion 20*b* shown in FIG. 5B, the vertical cylinder wall 16 and the two horizontal cylinder walls 18*a* are similarly connected at their respective distal ends 30, 32 and 34 at a joint 42. It can be seen that the joint 42 in this example does not include the closure member 60. In yet another alternative example of a corner portion 20*c* shown in FIG. 5C, instead of all of the respective distal ends 30, 32 and 34 of the vertical cylinder wall 16 and the two horizontal cylinder walls 18*a* meeting at the joint 42, an end cap 50 abuts portions of the respective distal ends 30, 32 and 34 at a joint 44 as generally shown. In the example, end cap 50 is spherical in shape, but other shapes, configurations and joints which will close and form a fluid tight corner known by those skilled in the art may be used.

In an alternate example not shown, the corners 20 may be rounded or spherical-shaped to more closely match the contour of the cylinder walls for manufacturing and/or assembly purposes.

The basic structure for the storage tank 12 is preferably composed of aluminum, although other materials, for example nickel steel, high strength pressure grade steel and other materials, known by those skilled in the art may be used. It is also understood that different components other than those described above and illustrated, as well as in different shapes and orientations, known by those skilled in the art may be used. In a preferred example, during manufacture, the constituent components of the storage tank 12 are rigidly and permanently joined together using a seam welding process in a manner to form a fluid-tight interior fluid storage chamber 22. For instance, the joints 40, 42 and/or 44 can be completed and sealed to form a fluid tight corner between the vertical 16 and horizontal 18 cylinder walls. The configuration of the completed joints, as well as the processes for completing the joints, may vary according to one or more design, strength, manufacturing and/or other considerations. Examples of these and other joints between constituent parts of the storage tank 12 are explained with reference to FIGS. 6A and 6B.

Figure 6A:
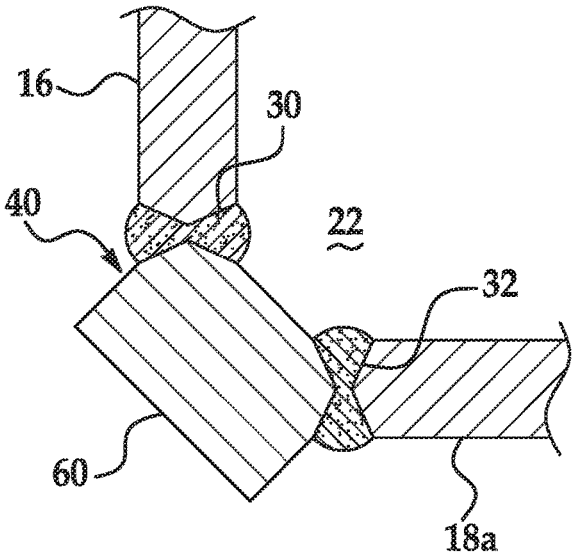
FIGS. 6A and 6B are section views taken along the line 6A-6A in FIG. 5A and line 6B-6B in FIG. 5B, respectively, showing example methods for completing a joint between constituent parts of the corner portions.

FIG. 6A is a cross section of the joint 40 in FIG. 5A between the vertical wall 16 and a horizontal wall 18*a*. According to this example, the storage tank 12 is assembled prior to completing the joint 40 such that a space or gap is present between the respective distal ends 30 and 32 of the vertical wall 16 and the horizontal wall 18*a* prior to completing the joint 40. As shown, a closure member 60 is sized and configured to substantially close the gap between the respective distal ends 30 and 32. The closure member 60 extends along the joint 40, and as can be understood with reference to FIGS. 4 and 5A, the closure member 60 has three generally annular, open ended ring shaped portions in the example corner portion 20*a*. However, the closure member 60 can have other shapes that may vary depending upon its application in alternative corner portions and/or joints between other constituent parts of the storage tank 12. The closure member 60 can have advantageous use where it is not feasible, cost effective or otherwise desirable to manufacture and/or assemble constituent parts of the storage tank 12 according to tolerances allowing for direct welding. Additionally or alternatively, the closure member 60 may be included to perform a strengthening or reinforcing function in the joint 40.

The respective distal ends 30 and 32 of the vertical wall 16 and the horizontal wall 18*a* are chamfered from both an interior side (facing the interior fluid storage chamber 22) and exterior side of the walls, such that a pointed vertex is formed at each of the distal ends 30 and 32, although the vertexes could alternatively be rounded, for example. The illustrated closure member 60 is shaped with a rectangular cross section and oriented so that pointed vertexes oppose each of the points of the distal ends 56 and 58. In this configuration, four inwardly tapering grooves are formed.

Specifically, two grooves are formed for receiving welds to join the vertical wall 16 to the closure member 60, and two grooves are formed for receiving welds to join the closure member 60 to the horizontal wall 18*a*. The cross section of the closure member 60 can be differently sized or shaped, for example, depending upon the size of the gap to be closed. It will be understood that one or more of the distal ends 30 and 32 and the closure member 60 could be shaped and configured otherwise than specifically illustrated. For instance, the distal ends 30 and 32 and the opposing portions of the closure member 60 could alternatively be rounded, for example, and the distal ends 30 and 32 and the closure member 60 could be formed so that grooves are only formed that open to one of an exterior side or interior side of the walls 16 and 18*a*.

Figure 6B:
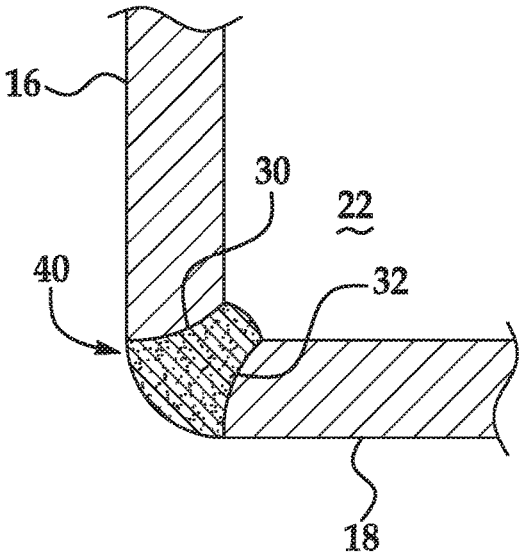

FIG. 6B is a cross section of the joint 42 in FIG. 5B between the vertical wall 16 and a horizontal wall 18*a*. According to the example joint 42 illustrated in FIG. 6B, the storage tank 12 is assembled prior to completing the joint 42 such that respective distal ends 30 and 32 of the vertical wall 16 and the horizontal wall 18*a* to be joined are substantially adjacent and can be continuously seam welded or otherwise mechanically joined together to complete the joint 42. In the illustrated example, the respective distal ends 30 and 32 of the vertical wall 16 and the horizontal wall 18*a* are chamfered from both the interior side and the exterior side of the walls, such that a pointed vertex is formed at each of the distal ends 30 and 32. Inwardly tapering grooves are formed by the opposing points of the distal ends 30 and 32, which are sized and shaped for receiving a weld to join the vertical wall 16 and the horizontal wall 18*a*. It will be understood that the distal ends 30 and 32 could alternatively be rounded, for example, or could be formed so that a single groove is formed that opens to only one of the exterior side or the interior side of the walls 16 and 18*a*.

Other configurations and orientations of the joints formed by the intersection of the vertical 16 and horizontal 18*a* cylinder walls at the corners portions known by those skilled in the art may be used. In addition, it will be understood that the illustrated joints are explained with reference to the corner portions only for illustration, and that the examples described are applicable in principle to any other joints or seams between constituent parts of the storage tank 12.

The disclosed storage tank containment system 10 includes additional external and/or internal structures configured to efficiently and effectively account for and manage the static and dynamic loads from a fluid contained within the storage tank 12, as well as the loads from the storage tank 12 as further described below.

A representative exterior support structure 100 connected to the outer surfaces of the storage tank 12 is illustrated in a first example with reference to FIGS. 1-3, 7 and 8. The support structure 100 is generally positioned about an exterior of the walls 14 to provide radial support and/or reinforcement to one or more portions of the storage tank 12, in order to strengthen the storage tank containment system 10 against stress arising from movement of the fluid within the interior fluid storage chamber 22, as well as a stress from the bulk of the storage tank containment system 10 as a whole. The first exemplary support structure 100 includes a plurality of first braces 102 (i.e., 102*a*, 102*b*, 102*c*, etc.), a plurality of second braces 104 (i.e., 104*a*, 104*b*, 104*c*, etc.), and a plurality of third braces 106 (i.e., 106*a*, 106*b*, 106*c*, etc.). A base 150, further described below, is also used. It will be understood that certain constituent components of the support structure 100 and base 150 that are described and/or illustrated as discrete connected components could be integral, for example, and vice versa.

In the first example, each of the braces 102, 104 and 106 are substantially planar members that extend outward from the storage tank 12 and have openings 108 (a representative opening 108 is indicated for the brace 102*a*) sized and shaped to closely circumscribe selected exterior portions of the storage tank 12. In the first example, the braces 102 and 104 are vertically oriented and horizontally spaced, and are aligned at right angles with respect to one another in parallel to the respective edges of the sides of the storage tank 12. The braces 106 are horizontally oriented and vertically spaced, and are similarly aligned in parallel to the respective edges of the sides of the storage tank 12. The braces 102, 104 and 106 are generally positioned and oriented to reinforce and provide radial support to selected outer portions of the adjacent horizontal and vertical cylinder walls 16 and 18 that respectively form the six sides of the storage tank 12.

For instance, in the first example, the braces 102, 104 and 106 interconnect to form portions 120 of the support structure 100 that circumscribe the storage tank 12 along the outwardly facing portions of the lower cylinder walls 18*a* that form the upright sides of the storage tank 12. It can be seen that the components of the portions 120 of the support structure 100 shown can further be shaped and positioned to abut a closure plate 300*b* or 300*c*, described in further detail below, as well as additional portions of the storage tank 12.

Each of the portions 120 of the support structure 100 comprises vertically oriented braces 102 abutting the outwardly facing portions of two parallel lower cylinder walls 18*a*, so as generally circumscribe parts of two opposing upright sides of the storage tank 12. In the illustrated example, the braces 102 further circumscribe a bottom side of the storage tank 12. The braces 102 extend vertically to a position approximately at the middle of the two opposing upright sides of the storage tank 12. The braces 102 are spaced horizontally such that an outer brace 102*c* of the braces 102 is positioned to extend upward along a vertical cylinder wall 16 in a radial direction from the vertical cylinder wall 16, as well as in abutment with a circumferential portion of a connected horizontal cylinder wall 18*a*.

The portions 120 similarly comprise vertically oriented braces 104 abutting the outwardly facing portions of the other two parallel lower cylinder walls 18*a*, so as generally circumscribe the bottom side of the storage tank 12, as well as parts of the other two opposing upright sides of the storage tank 12 than the braces 102. The braces 104 also extend vertically to a position approximately at the middle of the two opposing upright sides of the storage tank 12. The braces 104 are spaced horizontally such that an outer brace 104*c* of the braces 104 is positioned to extend upward along a vertical cylinder wall 16 in a radial direction from the vertical cylinder wall 16, as well as in abutment with a circumferential portion of a connected horizontal cylinder wall 18*a*.

Figure 3A:
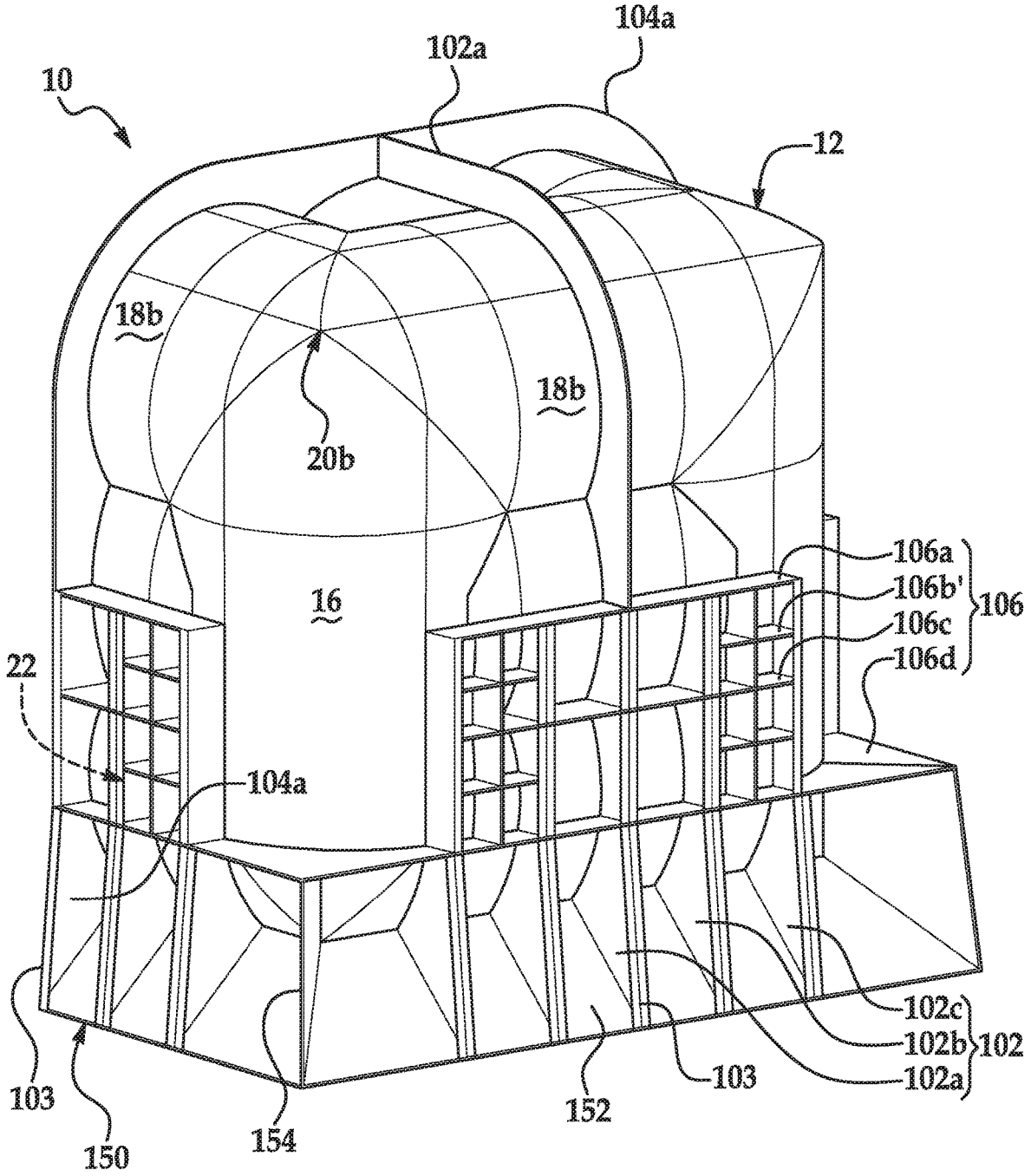
FIGS. 3A-3C are a perspective views of the storage tank system containment of FIG. 1 showing possible variations in the configuration of the support structure.

The horizontal braces 106 in this example can optionally rigidly interconnect the braces 102 and braces 104 comprising the portions 120 at each respective upright side of the storage tank 12. It will be understood that any of the braces 102, 104 and 106 can be provided in alternative numbers and/or configurations. For instance, as shown in FIG. 3A, a brace 106*d* may optionally be configured to substantially circumscribe the storage tank 12. The brace 106*d* is positioned to extend along the four horizontal cylinder walls 18*a* in a radial direction from the horizontal cylinder walls 18*a*, as well as in abutment with circumferential portions of connected vertical cylinder walls 16. In addition, it can be seen that certain portions of the braces 106 interconnecting the braces 102 and braces 104 are not included in this variation.

In addition, central braces 102*a* and 104*b* of the braces 102 and 104 are configured to substantially circumscribe the storage tank 12. As shown, the central braces 102*a* and 104*b* are positioned to abut the outwardly facing portions of four of the eight cylinder walls 18*a* and 18*b* that extend in parallel, so as generally circumscribe a bottom side of the storage tank 12, two opposing upright sides of the storage tank 12, and a top side of the storage tank 12. It can be seen that the central braces 102*a* and 104*b* intersect at the bottom side and the top side of the storage tank 12 and interconnect the four portions 120 of the support structure 100 circumscribing the outer portions of the four lower cylinder walls 18*a* as described above.

The concentration of braces 102, 104 and 106 toward the lower bottom half of the storage tank 12 are used to fortify the lower portion of the storage tank 12 and its capacity for hydrostatic and other forces. In the second example, T-plates 103 are selectively connected to braces 102 and 104 perpendicular to the braces to form a T-shaped section for increased strength of the braces against buckling and other deformation. As best shown in FIG. 2, it is also contemplated that concentrations of braces can be selectively incorporated into the base 150, for example, at a center of the bottom side of the storage tank 12.

Figure 3B:
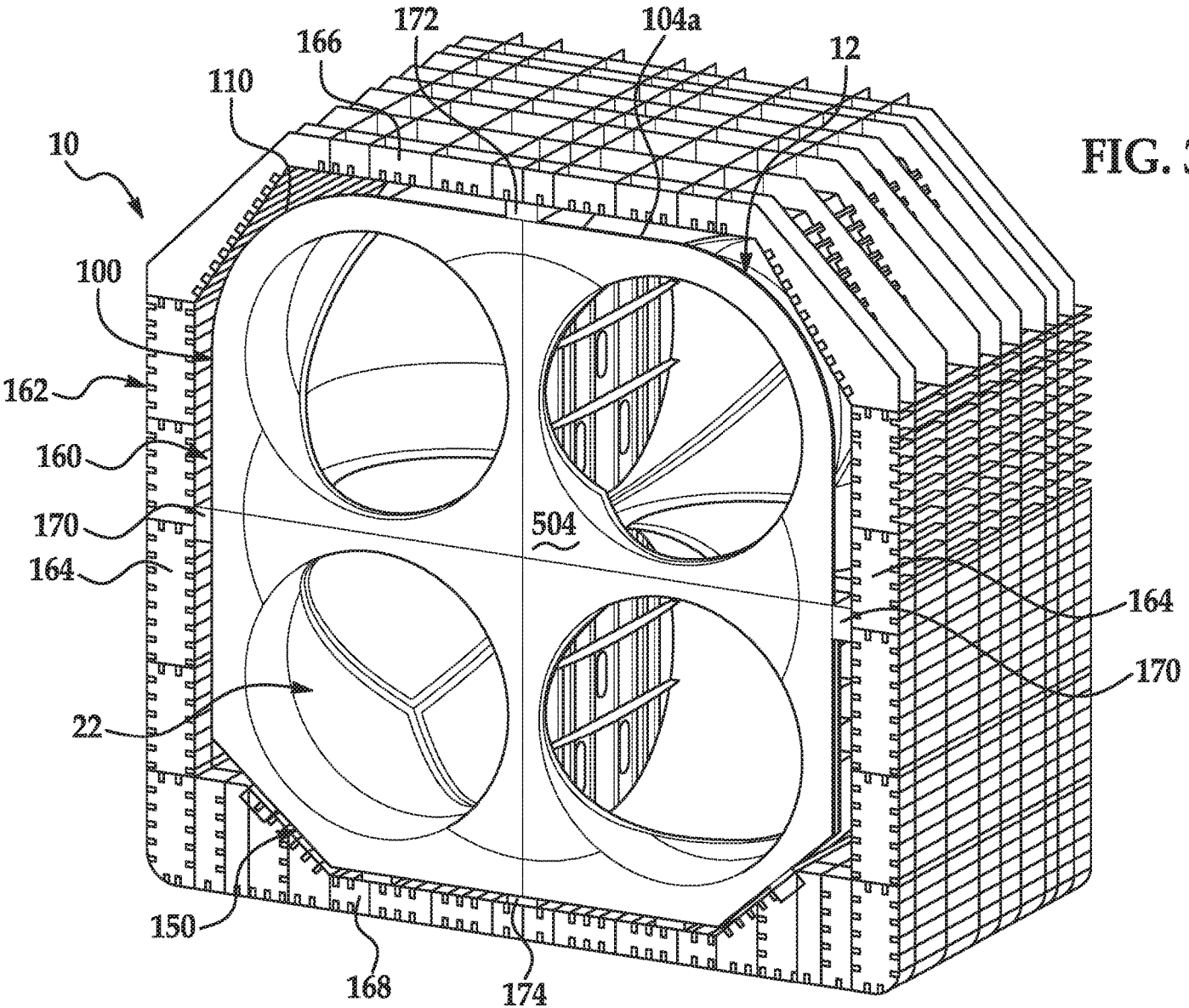
Figure 3C:
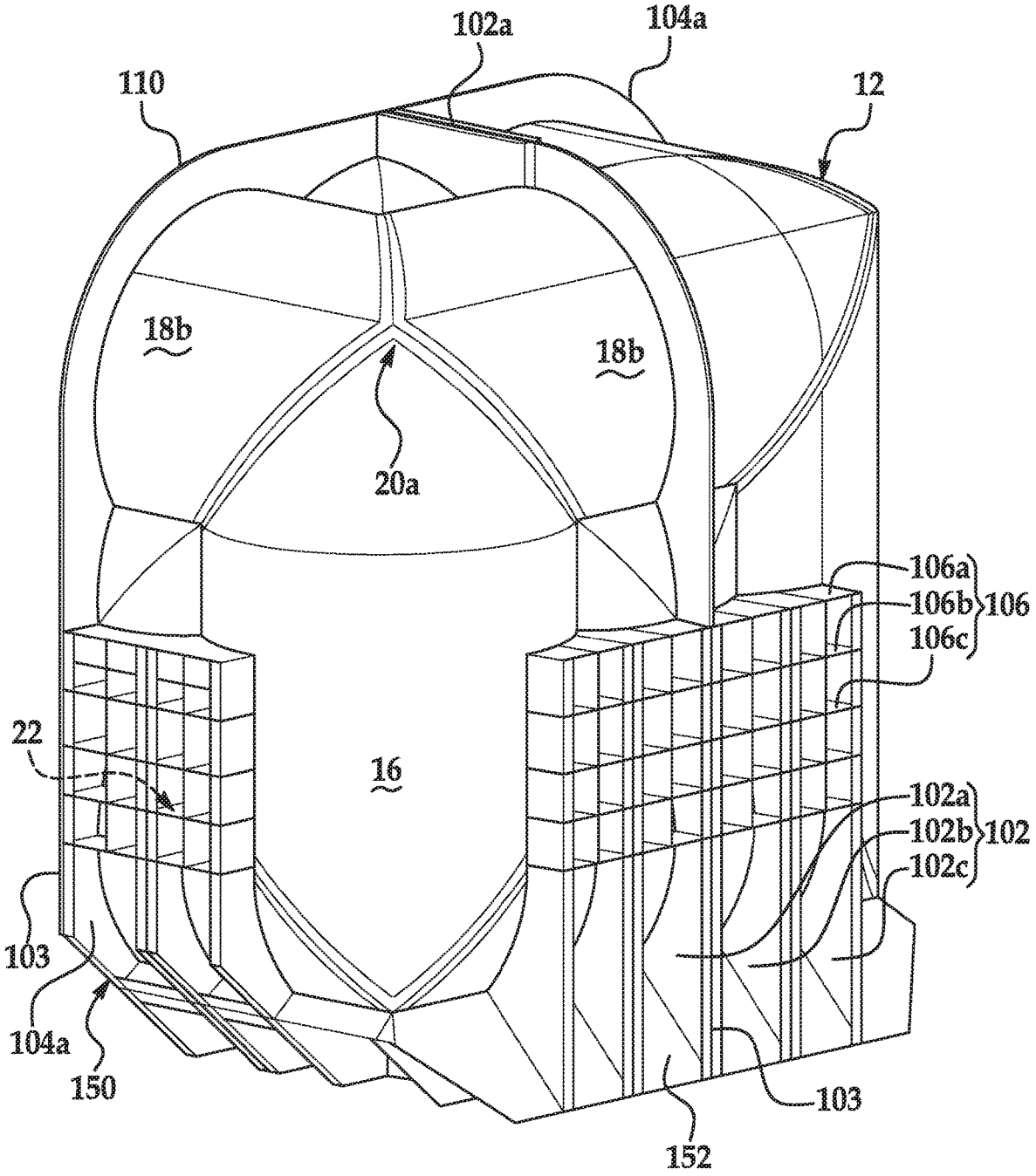

FIGS. 3B and 3C show an optional variation in the configuration of the support structure 100, wherein the support structure 100 is further designed to provide controlled lateral and vertical support to the storage tank 12 by accommodating the shape of a storage area, such as a cargo hold 160 of a marine carrier 162 (shown in FIG. 3B but not in FIG. 3C for clarity), into which the storage tank 12 is placed. For example, exterior surfaces or peripheries 110 (a representative plate 110 is indicated for the brace 104*a*) of the braces 102, 104 and 106 opposing the respective portions of the openings 108 that circumscribe the sides of the storage tank 12 can be configured to abut and/or engage upright walls 164 and/or an overhead wall 166 defining the cargo hold 160.

Further, or in the alternative, devices for securing the containment system 10 and the storage tank 12 to the cargo hold 160 may be positioned between the walls 164 of the cargo hold 160 and portions of the containment system 10 to inhibit movement of the containment system 10 with respect to the cargo hold 160 in the event, e.g., of a rolling or pitching motion of the carrier 162. For instance, as shown, chocks 170 are positioned between the upright walls 164 and upright portions of the support structure 100 of the containment system 10. Further, in the illustrated example, chocks 172 are positioned between the overhead wall 166 and an upper portion of the support structure 100. The chocks 172 may have advantageous use in the event, e.g., a flooding of the cargo hold 160, to inhibit the containment system 10 from floating. Although chocks 170 and 172 are shown and described, other devices known by those skilled in the art may be used.

In a preferred example, first 102, second 104 and third 106 braces are made from aluminum plate, and the respective openings 108 are sized to conform to the portions of the exterior of the storage tank 12 at which the braces are selectively positioned. It is understood that other materials described above for the walls 14, and others known by those skilled in the art may be used.

The storage tank containment system 10 includes a base 150 for supporting the storage tank 12 on a rigid support surface, for example, a floor 168 of the cargo hold 160. In one example, base 150 is formed by vertical braces 102 and 104 as best seen in FIG. 2. In the example, the peripheries 110 of the vertical braces 102 and 104 opposing the respective portions of the openings 108 that circumscribe the bottom of the storage tank 12 can form a substantially planar platform or surface to form a base 150, as shown in FIG. 2, providing a flat footprint for the storage tank 12 to abut a flat floor 168 of the cargo hold 160.

The base 150 can be formed partly or in whole with the braces 102 and 104, as described above, or can be formed with alternative structures, either alone or in combination with the braces 102 and 104. The illustrated base 150 is reinforced by an angularly oriented reinforcement skirt 152 adjacent to the bottom sides of the storage tank 12. As shown in FIG. 3A, a plurality of rigidly connected reinforcement webs 154 may also be used.

The base 150, skirt 152 and/or webs 154 can be shaped similarly to the support structure 100 as described above with reference to FIGS. 3B and 3C to accommodate the shape of the cargo hold 160. For example, the peripheries 110 of the vertical braces 102 and 104 forming the base 150 are chamfered in the variation of FIGS. 3B and 3C to approximate the cross section of the cargo hold 160 between the upright walls 164 and the floor 168.

Further, devices for supporting the containment system 10 and the storage tank 12 within the cargo hold 160 may be positioned between the floor 168 of the cargo hold 160 and the base 150. For instance, as shown, chocks 174 are positioned between the floor 168 and the base 150 of the containment system 10. Although chocks 174 are shown and described, other devices known by those skilled in the art may be used to support the containment system 10 within the cargo hold 160. The above described variation is provided as a non-limiting example, and it will be understood that many other variations in the components of the support structure 100 and/or base 150 are possible depending upon the specific configuration of the cargo hold 160.

The base 150 is secured to the adjacent storage tank 12 structures in the manner described for the walls 14 and braces 102, 104 and 106. The structures forming the base 150 can be made from the same materials as the braces described above or may be made from other materials and configurations known by those skilled in the art.

Figure 7:
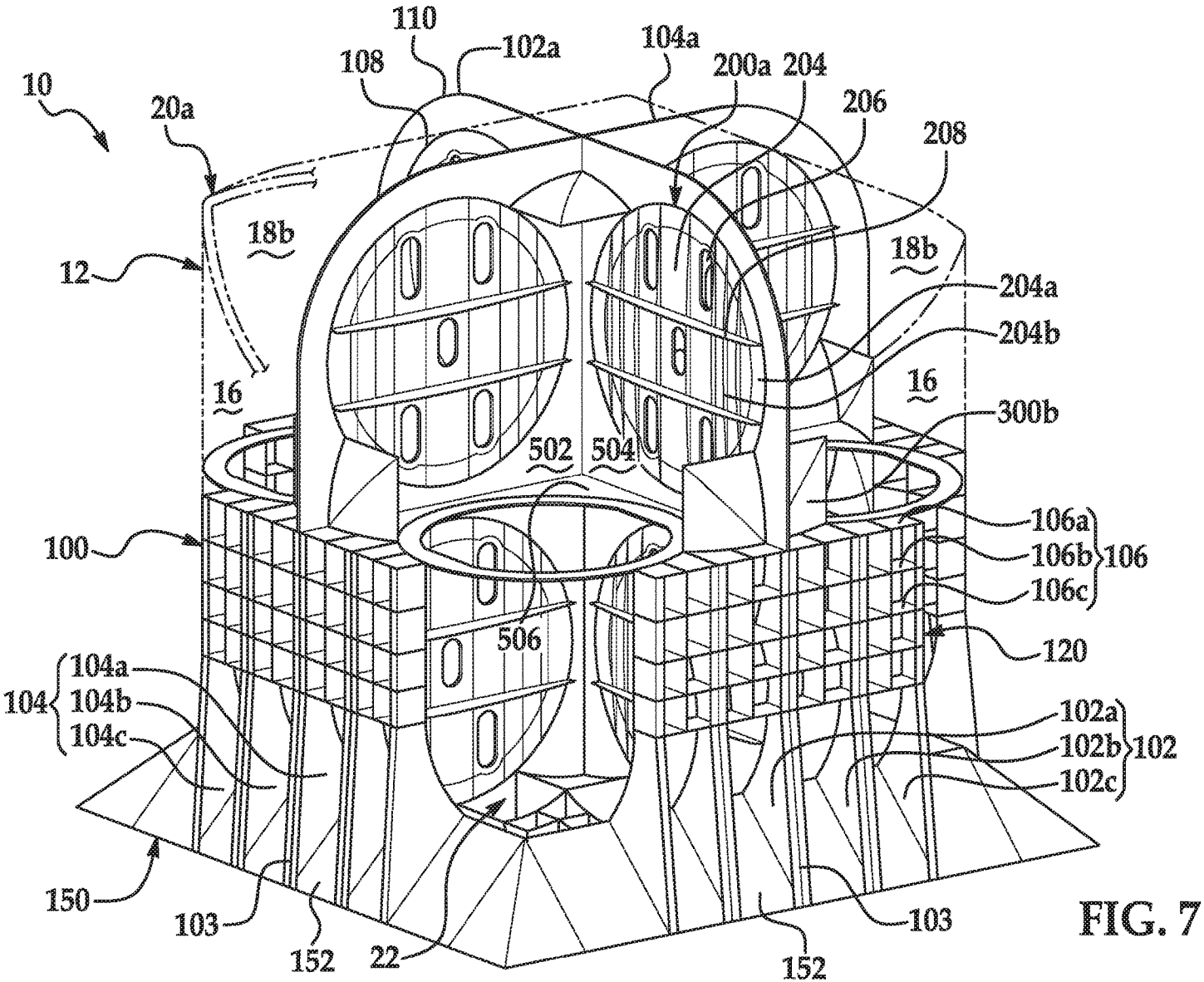
FIG. 7 is a perspective view of the storage tank containment of FIG. 1 with the storage tank in phantom to show examples of bulkheads positioned in the horizontal cylinder walls of the storage tank and gusset plates within the interior space of the storage tank.

FIG. 7 is illustrative of the features of the storage tank containment system 10 in the first example that incorporates certain of the above described inventive external, internal, and other structures for the storage tank 12. The storage tank containment system 10 of FIG. 7 includes the storage tank 12 having the above described corner portions 20*a* formed in combination with the closure member 60 as shown in FIGS. 4, 5A and 6A. The support structure 100 and base 150 are constructed in accordance with the discussion of FIGS. 1-3, 7 and 8. As shown, the example further includes internal structures configured for the storage and management of fluid within the interior fluid storage chamber 22 and elsewhere.

For example, as shown in FIG. 7, the storage tank containment system 10 includes the bulkhead structure 200*a*, wherein the planar plate 204 is composed of the reinforcing outer periphery 204*a* and the membrane inner portion 204*b* configured to partially obstruct a flow of liquid by defining the ovoid apertures 206. The interior space 295 is defined in part with the closure plates 300, and houses the crossing gusset plates 502, 504 and 506 positioned between and rigidly connected to the walls 14.

The exemplary storage tank 12 has dimensions of 150 feet (f) or 50 meters (m) per geometric side. In an application of storing LNG, the thickness of aluminum plate forming the bottom horizontal cylinder walls 18 can vary between approximately 2-5 inches, the thickness of aluminum plate forming the top horizontal cylinder walls 18 can vary between approximately 0.5-3 inches, the thickness of aluminum plate forming the vertical horizontal cylinder walls 16 can vary between approximately 2-4 inches, the thickness of aluminum plate forming the bottom corner portions 20 can vary between approximately 3-6 inches, and the thickness of aluminum plate forming the top corner portions 20 can vary between approximately 1-3 inches. Aluminum forming the closure plate 3000 can vary in thickness between approximately 2-4 inches. Aluminum forming the closure member 60 can vary in thickness between approximately 4-6 inches at the bottom corner portions 20, and between 3-4 inches at the top corner portions 20.

The thickness of aluminum plate forming the components of the support structure 100 and the above described internal structures and reinforcements can generally vary between approximately 1-3 inches, Certain portions of the support structure 100, for example the T-plates 103 and reinforcing outer periphery 204*a* of the planar plate 204, can formed from aluminum plate with a thickness varying between approximately 3-6 inches.

The composition and configuration of the components of the representative exterior support structure 100 may vary according to one or more design, strength, manufacturing and/or other criteria. For example, it is contemplated that the above described exterior support structure 100 can be modified or differently designed according to actual, anticipated and/or simulated static and dynamic loads from a fluid contained within the storage tank 12, as well as the loads from the storage tank 12 itself. Therefore, it will be understood that variations in the number, placement and orientation of the braces 102, 104 and 106 can be made. Similar variations in the construction and materials of the base 150 known by those skilled in the art may be used. One instance of a possible modification to the representative exterior support structure 100 is utilized in a second example of a storage tank containment system 10 shown in FIGS. 11-19.

Figure 11:
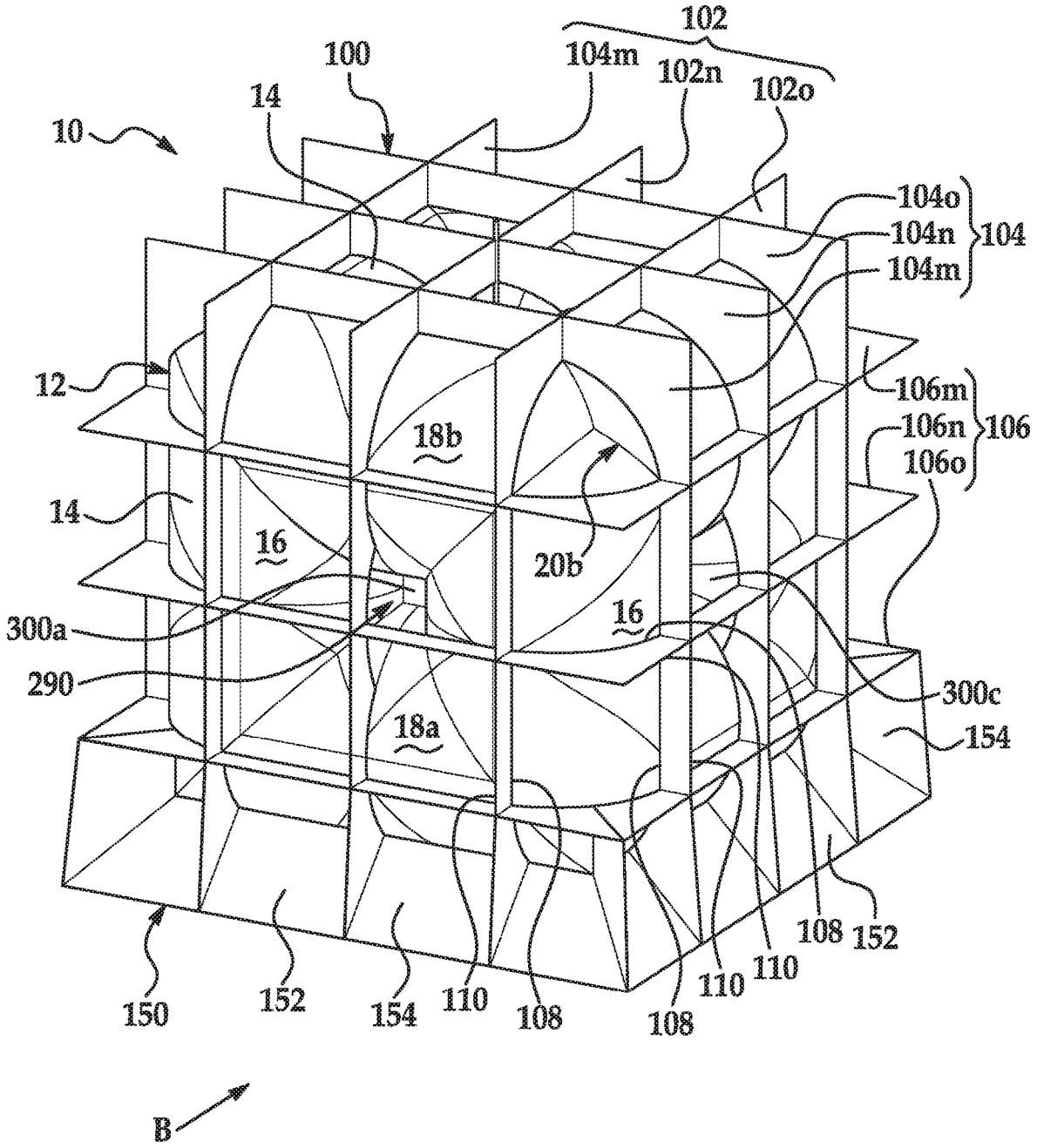
FIG. 11 is a perspective view of a second example of a storage tank containment system having the storage tank and an alternate storage tank support structure.
Figure 12:
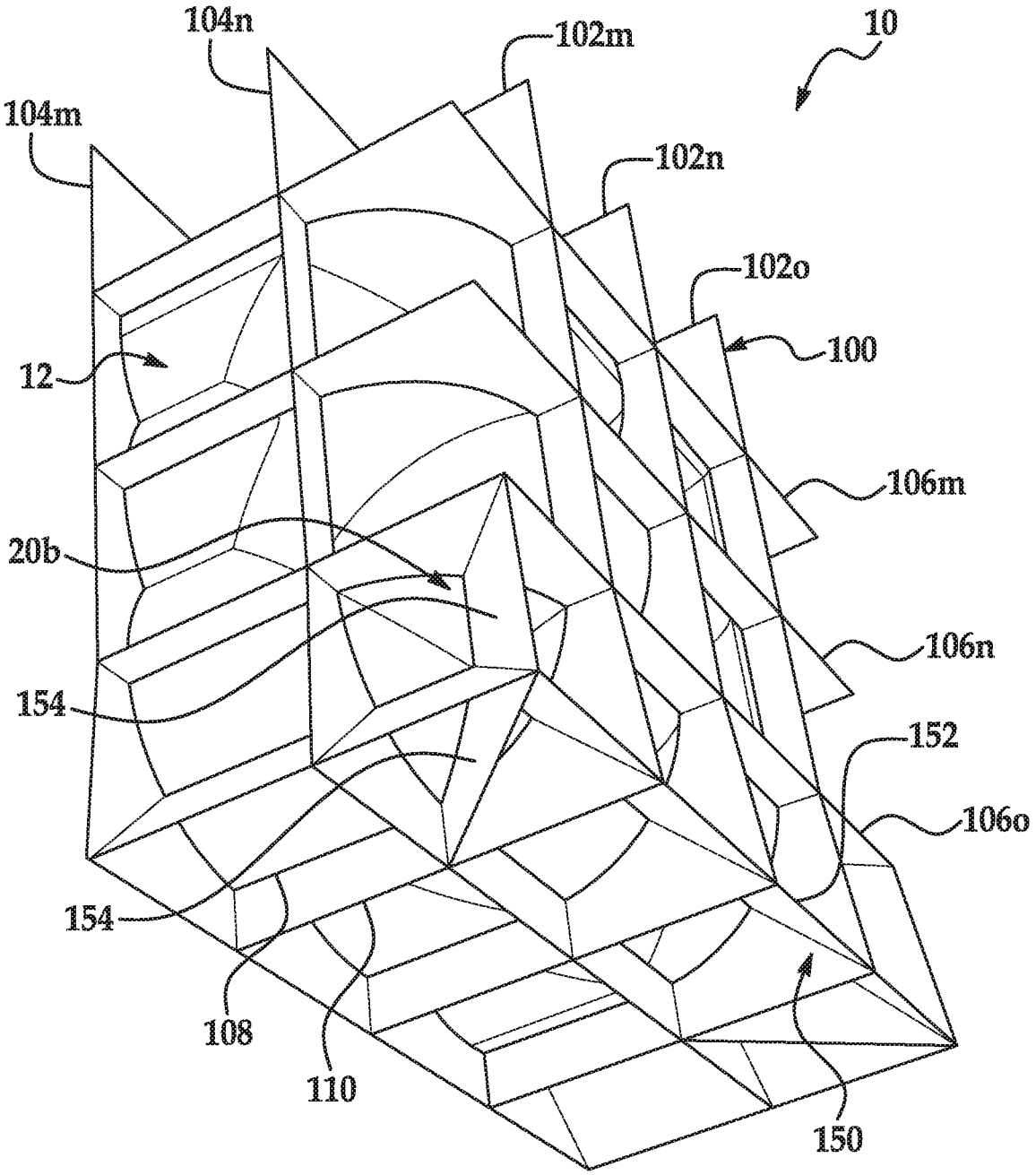
FIG. 12 is a perspective view of the bottom side of the storage tank containment system of FIG. 11 as viewed from the direction of B in FIG. 11.

Referring to FIGS. 11 and 12, the support structure 100 in the second example generally includes the first braces 102 (identified with 102*m*, 102*n* and 102*o* in the second example), second braces 104 (identified with 104*m*, 104*n* and 104*o*, and third braces 106 (identified with 106*m*, 106*n* and 106*o*). The base 150 as generally described above with is also used. In the second example, each of the braces 102, 104 and 106 are substantially planar members that each defines an interior opening 108 sized to closely circumscribe selected exterior portions of the storage tank 12.

In the second example, the braces 102 and 104 are vertically oriented and horizontally spaced, and are aligned at right angles with respect to one another in parallel to the respective edges of the sides of the storage tank 12. The braces 106 are horizontally oriented and vertically spaced, and are similarly aligned in parallel to the respective edges of the sides of the storage tank 12. As with the first example, the braces 102, 104 and 106 are generally positioned and oriented to reinforce and provide radial support to selected outer portions of the adjacent horizontal and vertical cylinder walls 16 and 18 that respectively form the six sides of the storage tank 12.

In the second example, each of the braces 102, 104 and 106 are configured to substantially circumscribe the storage tank 12. In relation to a single side of the storage tank 12, two outer braces 102*m* and 102*o* of the braces 102 are each positioned to extend upward along a vertical cylinder wall 16 in a radial direction from the vertical cylinder wall 16, as well as in abutment with circumferential portions of connected horizontal cylinder walls 18*a* and 18*b*. Similarly, two outer braces 104*m* and 104*o* of the braces 104 are each positioned to extend upward along a vertical cylinder wall 16 in a radial direction from the vertical cylinder wall 16, as well as in abutment with circumferential portions of connected horizontal cylinder walls 18*a* and 18*b*. Finally, two outer braces 106*m* and 106*o* of the braces 106 are each positioned to extend horizontally along a horizontal cylinder wall 18 in a radial direction from the horizontal cylinder wall 18, as well as in abutment with circumferential portions of connected vertical cylinder walls 16.

Although the outer of the braces 102, 104 and 106 are described for clarity in relation to a single face of the storage tank 12, it will be understood from the Figures that the outer of the braces 102, 104 and 106 may be configured to circumscribe multiple faces of the storage tank 12. For instance, it can be seen that the outer of the braces 102, 104 and 106 can circumscribe four faces of the storage tank 12 to generally form a loop around the storage tank 12, with four constituent portions each positioned and oriented similarly in principle to those described above with respect to a single face.

Central braces 102*n* and 104*n* are positioned to abut the outwardly facing portions of four of the eight cylinder walls 18*a* and 18*b* that extend in parallel, so as generally circumscribe a bottom side of the storage tank 12, two opposing upright sides of the storage tank 12, and a top side of the storage tank 12. Central brace 106*n* is positioned to abut the outwardly facing portions of the four vertical cylinder walls 16, so as generally circumscribe all four upright sides of the storage tank 12. The central braces 102*n*, 104*n* and 106*n* can span spaces 290 on the sides of the storage tank 12 created between the spaced cylinder walls 14. However, the medial brace can further be shaped and positioned to abut a closure plate 300*c*, described in further detail below.

It can be seen that the braces 102, 104 and 106 positioned as described and shown can be rigidly interconnected at their respective intersections to form a reinforcing lattice structure around the storage tank 12. In one variation of the second example of the representative exterior support structure 100 not shown, it is contemplated that one or more of the upper braces 106 can be reduced in load bearing capacity due to the gradual reduction in hydrostatic forces placed on the storage tank 12 by its contents. For example, because the hydrostatic load on an interior of the walls 14 will be greater nearer the base 150, a support structure 100 including a plurality of horizontally oriented braces 106 can include a first brace 106 relatively stronger than a second brace 106 positioned further from the base 150 than the first brace 106. It is further contemplated, however, that depending on the application, such gradual reduction in hydrostatic forces may be offset by anticipated dynamic loading in certain applications.

Like the first example, the first 102, second 104 and third 106 braces of the second example are made from aluminum plate, and the respective openings 108 are sized to conform to the portions of the exterior of the storage tank 12 at which the braces are selectively positioned. It is understood that other materials described above for the walls 14, and others known by those skilled in the art may be used.

The disclosed storage tank containment systems 10 of the first and second examples further includes internal structures configured for the storage and management of fluid within the interior fluid storage chamber 22, or elsewhere, as described below, as well as for further reinforcement of the storage tank 12. It will be understood that the various internal structures and other features described below with reference to one or both of the first and second examples of the storage tank containment system 10 can be used in any combination with each other, as well as in further combination with one or more features of the above described examples of the support structure 100.

In a preferred example of a containment system 10 for storing liquids, such as LNG, the storage tank 10 can include bulkhead structures 200*a*, 200*b*, 200*c* and/or 200*d* positioned within and secured to the interior fluid storage chamber 22, as shown in FIGS. 7, 13, 17 and 18, respectively. The bulkhead structures 200 are located in each of the horizontal cylinder walls 18 as generally shown in the Figures for deterring or easing the sloshing or dynamic movement of the fluid contained in the interior fluid storage chamber 22.

In one example, each bulkhead 200 is positioned and secured to the adjacent horizontal cylinder walls 18 in a substantially midstream location. As explained above, the sloshing movement of liquid contained in the walls 14 creates a corresponding dynamic load on the interior of the walls 14. The bulkhead structures 200 provide an internal structure to partially obstruct flow of the liquid contained in the horizontal cylinder walls 18, which reduces the extent of sloshing and lowers the magnitude of the dynamic loads received by the ends of the horizontal cylinder walls 18. In addition, it will be understood that all or part of the bulkhead structures 200 may be configured to perform a reinforcing function of the cylindrical cross section of the walls 14.

As shown in FIG. 7, an exemplary bulkhead structure 200*a* includes a substantially planar plate 204 configured to span a cross section of the horizontal cylinder walls 18 defining a portion of the interior fluid storage chamber 22. In the example, the planar plate 204 defines a plurality of ovoid apertures 206 arranged in an "x" pattern about the plate 204 to permit fluid communication on either side of the plate 204.

A material of an outer periphery 204*a* of the planar plate 204 may be relatively more rigid than a material of an inner portion 204*b* of the planar plate 204. In this arrangement, the outer periphery 204*a* of the planar plate 204 performs a reinforcing function for the cylindrical cross section of the wall 14, while the inner portion 204*b* acts as a membrane to partially obstruct flow of the liquid contained in the horizontal walls 18 by, for example, defining the apertures 206 as shown. Although it is understood that a variety of materials in varying thicknesses may be used, in an application of tank system 10 in the size example noted above for containing LNG, a thickness of an aluminum material forming the plate 204 may be approximately 4-5 inches at the outer periphery 204*a*, while the inner portion 204*b* may be approximately 1-2 inches thick. In this example, a plurality of cross members 208 may be further provided to reinforce the inner portion 204*b* against a dynamic loading normal to the planar plate 204 arising from a flow of liquid contained in the horizontal walls 18.

It is understood that alternate configurations for the planar plate 204 can be used, and that more or fewer apertures may be used and that the apertures 206 can have any suitable polygonal or rounded profile to suit the particular contents or application as known by those skilled in the art. For instance, the planar plate 204 may be configured with substantially uniform thickness. In addition, in the example bulkhead structure 200*b* shown in FIG. 13, each plate 204 defines six rectangular apertures 206 arranged in two rows of three apertures 206. In another example of a bulkhead structured 200*c* shown in FIG. 18, a plurality of polygonal apertures 206 are arranged about a periphery of the planar plate 204. In the example of a bulkhead structure 200*d* shown in FIG. 19, a plurality of polygonal apertures 206 are arranged uniformly about the planar plate 204.

Figure 15:
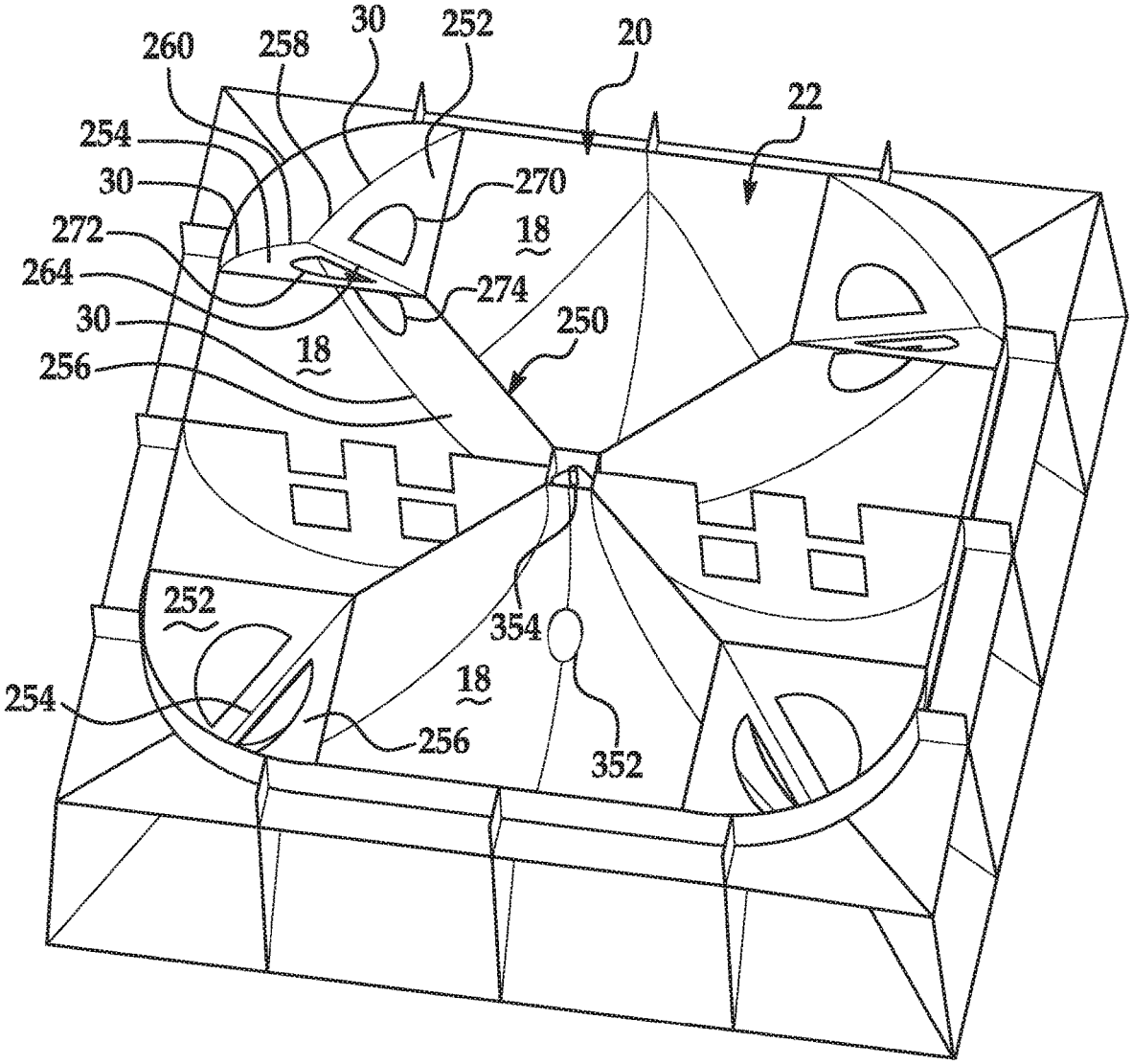
FIG. 15 is a cut-away perspective view of the storage tank containment system in FIG. 11 showing an example of corner reinforcements positioned in the bottom corners of the storage tank.
Figure 16:
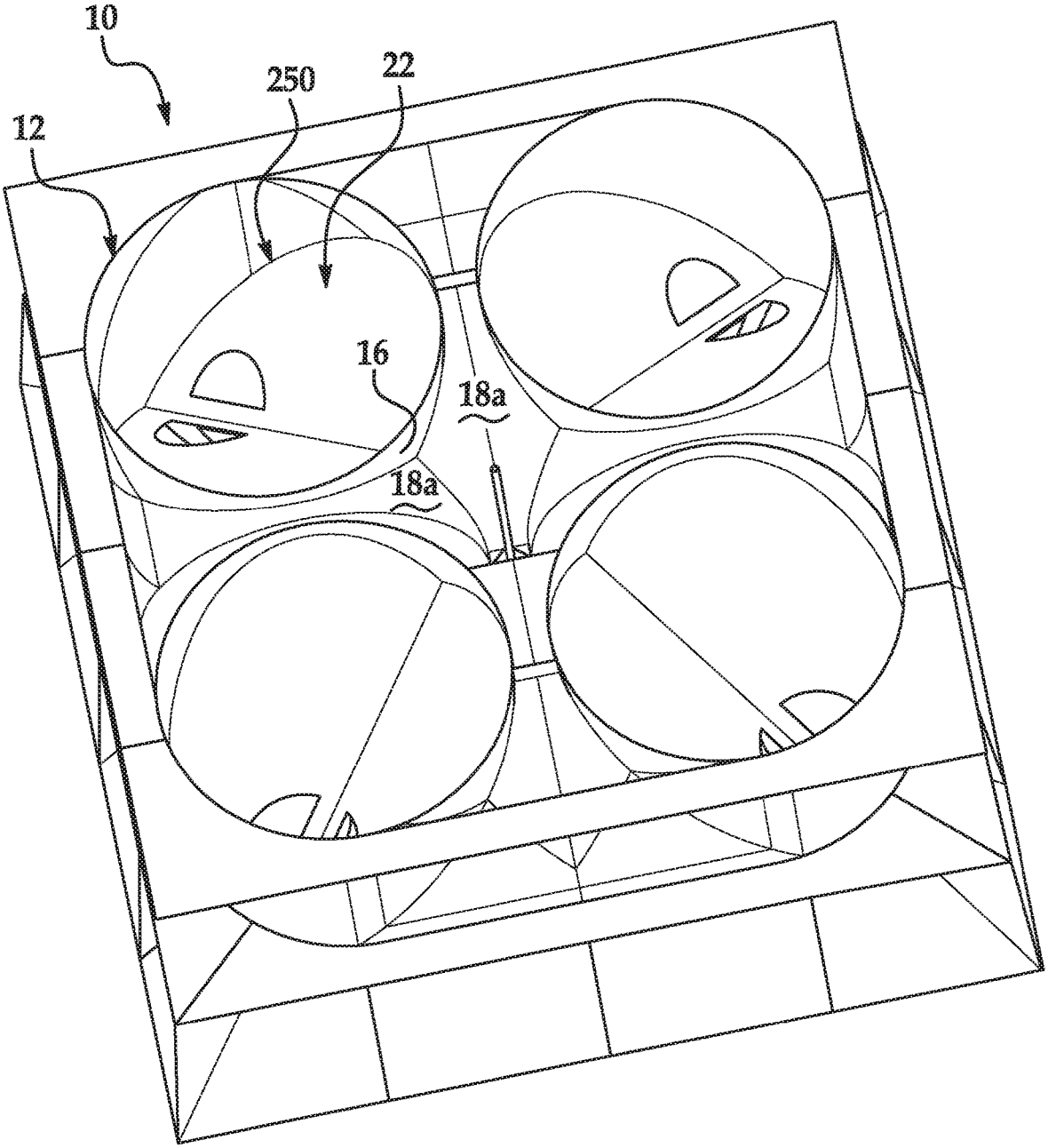
FIG. 16 is an alternate cut-away perspective view of the storage tank containment system in FIG. 11 showing an example of corner reinforcements positioned in the bottom corners of the storage tank.
Figure 17:
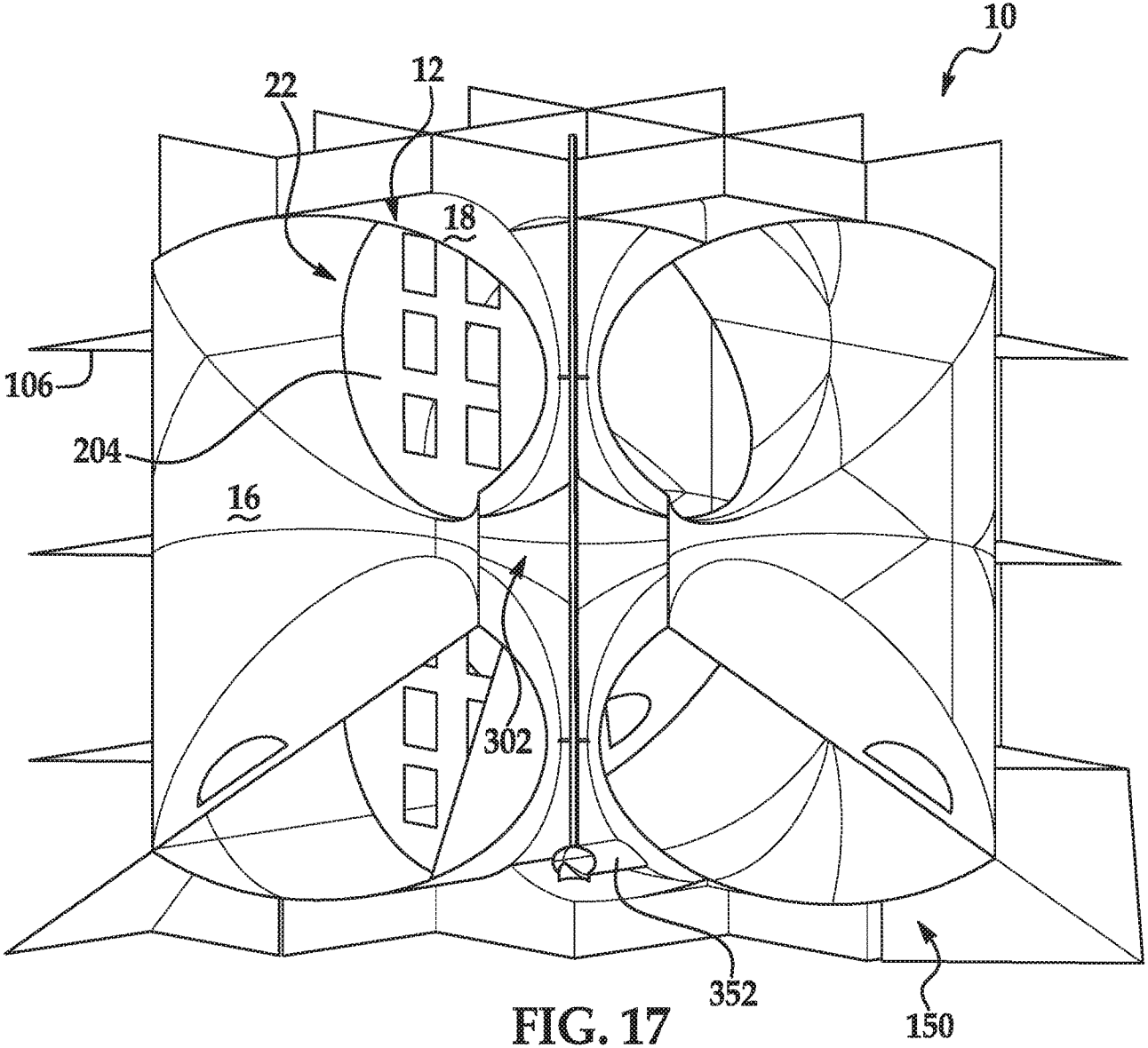
FIG. 17 is an alternate cut-away perspective view of the storage tank containment system in FIG. 11.

FIGS. 15 and 16 show examples of horizontal, cut-away sections of the containment system 10 illustrating an example of a corner reinforcement 250 provided to reinforce the interior of corner portions 20. Referring to FIG. 15, a corner reinforcement 250 positioned in a bottom corner portion 20 of the storage tank 12 includes a first plate 252, a second plate 254 and a third plate 256 (angularly positioned below and extending downward from the first and second plate). The first 252, second 254 and third 256 plates span respective portions of the corner portion 20 and connect to the respective inner walls of the corner portion 20 inside interior fluid storage chamber 22 as best seen in FIG. 16 (showing all four lower corner portions 20 having a corner reinforcement 250). It is understood some or all of the corner portions 20 may include a corner reinforcement 250, and that one or more of the corner reinforcements 250 may not be needed depending on the application.

In one example, a first plate first edge 258, a second plate first edge 260, and a third plate first edge 262 each connect to the corner 20 along the adjacent joint 30 formed by a vertical cylinder wall 16 and horizontal cylinder walls 18. The first plate 252, second plate 254, and third plate 256 connect at a joint 264. In one example, first 252, second 254 and third 256 plates are spaced 120 degrees apart. It is understood that corner reinforcements 250 may take other configurations, plate or web formations to suit the particular application as known by those skilled in the art.

In the example bulkhead structure 250, each of the first plate 252, second plate 254 and third plate 256 define respective through apertures 270, 272 and 274 to permit fluid communication on either side of the plates, such that portions of the interior fluid storage chamber 22 are not blocked off otherwise compartmentalized. As shown in FIG. 15, a bulkhead structure 250 can be positioned in each top corner portion 20 of the storage tank 12. It will be understood by those skilled in the art that other configurations and orientations for the bulkhead structure 250 may be used, and other reinforcements may be positioned in a corner portion 20.

Figure 19:
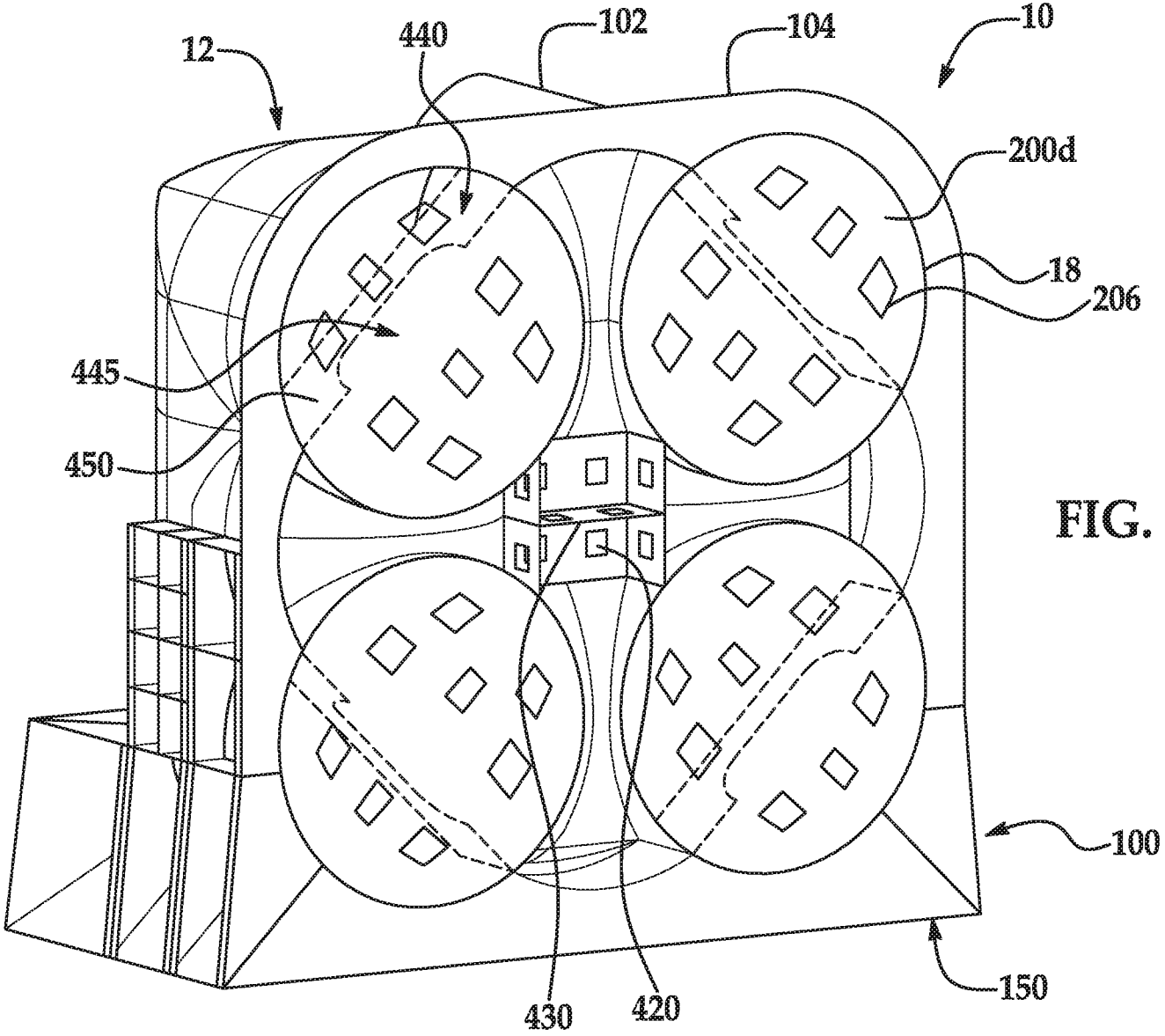
FIG. 19 is an alternate partially cut-away perspective view of the storage tank containment system in FIG. 11 showing alternate examples of corner reinforcements and gussets plates.

Referring to FIG. 19, an alternate example of a corner reinforcement 440 is shown. In the example, tank corner 20 reinforcement 440 is in the form of a plate 445 (only one-half of the plate shown in the sectional view in FIG. 19) defining an interior aperture 450 (surrounded by plate material 445). In the example, the plate 445 is angled at approximately 45 degrees and is seam welded on its ends, or alternately all around its perimeter to adjacent walls of the corner portion 20 and the adjacent vertical 16 and horizontal 18 cylinder walls. The aperture 450 serves to reduce weight and provide resistance to sloshing of the stored fluid as described above.

Other forms, configurations, orientations and positions of corner reinforcements to suit the particular application known by those skilled in the art may be used. The material used to construct the storage tank 12 as described above may be used to construct the bulkheads 200, 250 and 440. In one example, the illustrated bulkheads 200, 250 and 440 are rigidly and continuously seam welded to the storage tank 12.

It will be understood that the illustrated corner reinforcements 250 and 440 may not be necessary or desirable in certain applications. Certain disclosed embodiments, for example the embodiment of FIGS. 1-10 with the first example of the exterior support structure 100, may not include corner reinforcements, as can be seen with reference to FIGS. 7-9, In this and other examples, the reinforcing function of the illustrated corner reinforcements 250 and 440, if desired, may be performed by other aspects of the storage tank 12 and/or exterior support structure 100.

In the example of the storage tank 12 described and illustrated above, the twelve cylinder walls 16 and 18 are closed sectioned, forming an interior fluid storage chamber 22. In this example, openings 290 form on each of the six sides of the tank 12, leading to an interior space 295 between the interior facing walls of the cylinders. In the examples of the storage tank containment system 10 shown throughout the Figures, the openings 290 are sealed closed and the interior space 295 is placed in fluid communication with the interior fluid storage chamber 22 inside the cylinders to utilize the interior space 295 as additional storage for the fluid, as explained below.

Figure 9:
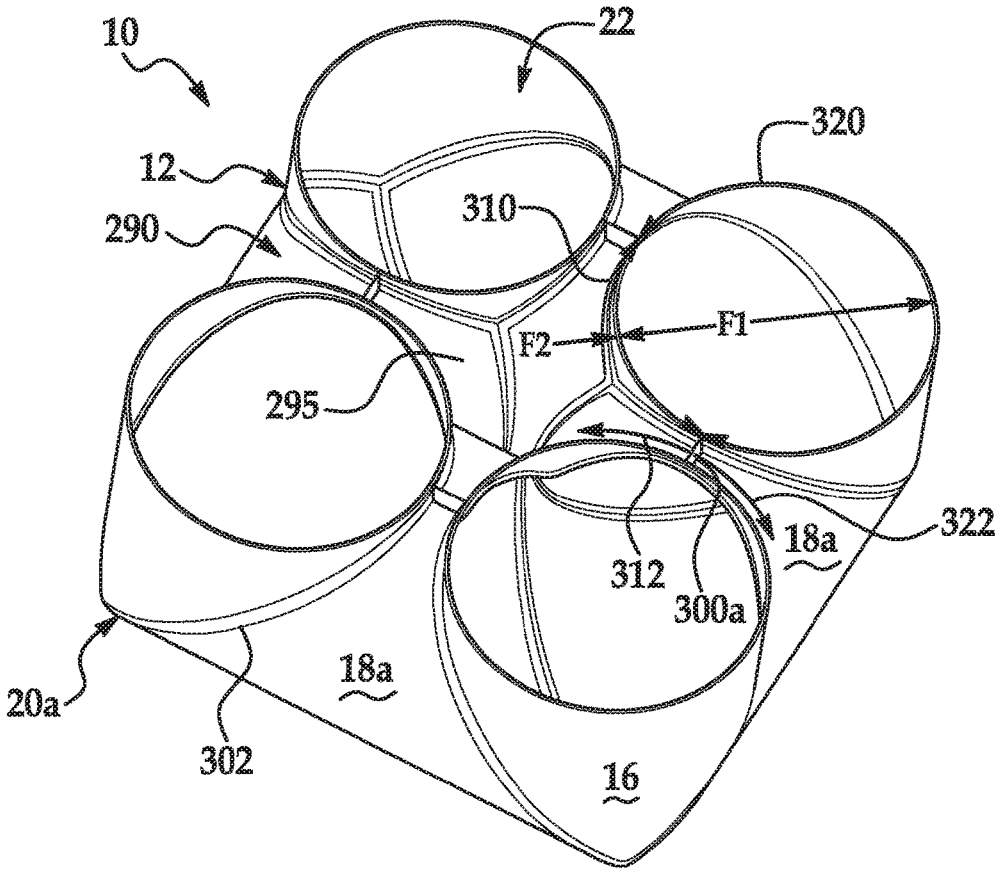
FIG. 9 is a cut-away perspective view of the storage tank of FIG. 1 taken along the line 9-9 showing an interior space formed between the cylinder walls.

With representative reference to FIG. 9, it can be seen that closure plates 300*a* and interior facing portions of the exterior cylinder walls 16 and 18*a* (e.g., an interior portion 310 of a vertical cylinder wall 16 and interior portion 312 of a horizontal cylinder wall 18*a* are indicated) may be used to seal off and define an auxiliary storage chamber 302 defined by the closure plates 300*a* and the interior wall portions 310 and 312 of the cylinder walls 16 and 18*a* forming the storage tank 12.

Figure 10A:
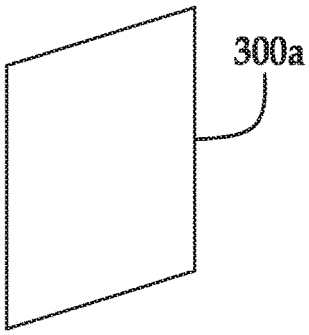
FIGS. 10A-10C are perspective views of examples of closure plates shown throughout the Figures for closing off the interior space shown in FIG. 9.
Figure 10B:
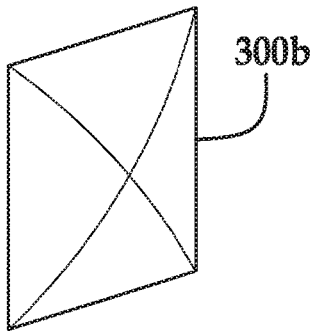
Figure 10C:
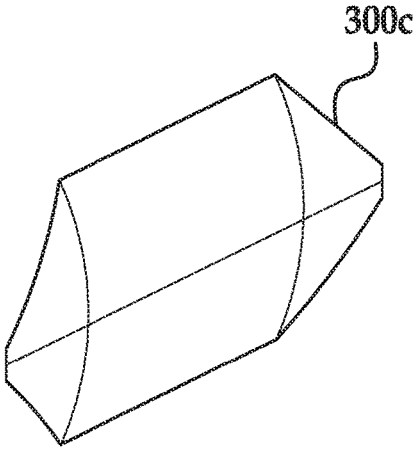

A number of configurations of closure plates 300 are shown throughout the Figures, which are explained with additional reference to FIGS. 10A-C. In the example shown in FIG. 10A, the closure plate 300*a* is planar and configured to extend normally between adjacent walls 14. In an alternate example shown in FIG. 10B, closure plate 300*b* is spherical or rounded and generally extends between adjacent walls 14, but at a position further outward of an imaginary line connecting longitudinal axes of adjacent walls 14. In the alternate example shown in FIG. 10C, closure plate 300*c* is also spherical or rounded, but extends between adjacent walls 14 at an outer portion of the walls 14, such that the closure plate 300*c* extends generally tangentially between adjacent walls 14.

Through use of the closure plates 300*a*, 300*b* or 300*c*, and corresponding use of interior space 295 for storage, increased storage capacity is achieved. In one example of a tank 12 with dimensions described above, the volumetric storage efficiency of tank system 10, as compared to a similarly dimensioned cube, increases from about 0.81 to 0.88, which is far superior to prior designs. Further, when using closure plates 300*b*, 300*c* connected at positions increasingly outboard of the center of the tank 12, heat losses are reduced, that is, less of the exterior surface of the tank 12 includes bends and corners prone to acting as heat sinks.

The storage tank containment system 10 may be configured to include only one type of the closure plates 300*a*, 300*b* and 300*c*, for example, or may be configured to include a mixture of the closure plates 300*a*, 300*b* and 300*c*, as well as other closure plates not specifically illustrated, such as triangular or I-shaped closure plates. Closure plates 300*a*, 300*b* and 300*c* can be made from the materials used for the walls 16, 18*a* as described above. It will be understood by those skilled in the art that other configurations and orientations for the closure plates 300*a*, 300*b* and 300*c* may be used to seal and define an auxiliary storage chamber 302.

As best seen in FIG. 9, in one example described above where the cylinder walls 14 are closed-sectioned and the interior fluid storage chamber 22 serves as the only storage area, the cylinder walls 16 and 18*a* have exterior portions 320 and 322, respectively, for example the outer half or circumference of the circular cross-section which faces toward the exterior of the tank, and respective interior portions 310 and 312. As shown in FIG. 9, the respective first and second wall portions may be defined by or positioned near the location of the closure plates 300*a*.

As further shown in FIG. 9, liquid contained in the interior fluid storage chamber 22 exerts a radial hydrostatic force F1 to an interior 310 of the vertical cylinder wall 16. The load bearing capacity of the vertical cylinder wall 310,320 must be sufficient to account for the force F1. Where closure plates 300*a* are not employed and the auxiliary storage chamber 302 (or space 295) is not utilized for storage, the interior wall portions 310 must withstand similar loads as the exterior wall portions 320 and require substantially similar construction. In an application of tank system 10 in the size example noted above for containing LNG, the thickness of walls 16 and 18 for aluminum are estimated to be between 1 and 6 inches thick. For steel, a thickness of 0.5-4 inches may be used. Other thicknesses, depending on the material used and application, known by those skilled in the art may be used.

However, where closure plates 300*a* (or closure plates 300*b* or 300*c*) are employed and the auxiliary storage chamber 302 utilized, the inclusion of a liquid in the auxiliary storage chamber 302 will create an opposing radial hydrostatic force F2 to the opposite side of the vertical cylinder wall portion 310 that partially defines the auxiliary storage chamber 302. Because the hydrostatic force F2 counteracts and counterbalances the hydrostatic force F1, the load bearing capacity and corresponding thickness of the vertical cylinder wall 16 and horizontal cylinder wall 18*a* can be reduced in the respective wall portions 310 and 312, which reduces the mass and the material cost of the storage tank 12.

In the example of the storage tank 12 utilizing only interior fluid storage chamber 22 within the cylinder walls 14, one or more ports in the exterior of the walls (not shown) in communication with interior chamber 22 can be used to fill or withdraw fluid from the interior fluid storage chamber 22. Where auxiliary storage chamber 302 is used along with interior fluid storage chamber 22, one or more ports (not shown), for example on wall portions 310 and/or 312 can be provided in the appropriate walls 14 to provide fluid communication between the interior fluid storage chamber 22 and the auxiliary storage chamber 302.

Figure 18:
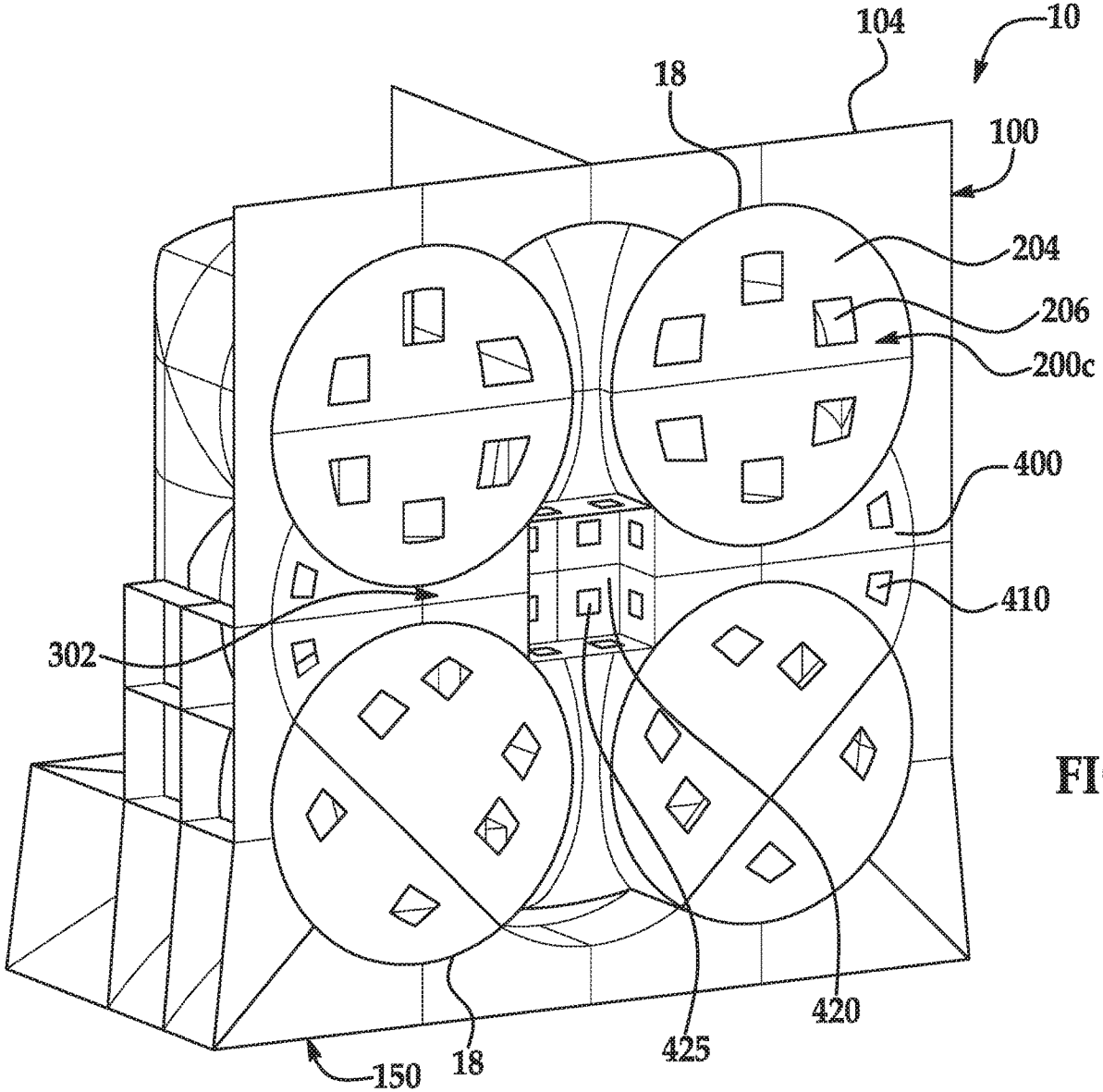
FIG. 18 is an alternate partially cut-away perspective view of the storage tank system in FIG. 11 showing further examples of gusset plates within the interior space of the storage tank.

Referring to FIG. 18, an example of first gusset plates 400 (two shown) are illustrated. In the example, each gusset plate 400 is positioned between the vertically adjacent horizontal tube walls 18 in the auxiliary storage chamber 302 and is rigidly connected thereto. Each gusset plate 400 may include one or more apertures 410 (two shown) to permit the flow of fluid through the gusset plate 400 to deter sloshing of fluid in the auxiliary storage chamber 302 as generally described for bulkheads 200 described above. In one example, the gusset plates are rigid planar plates, but may take other forms and configurations to suit the application as known by those skilled in the art.

As also seen in FIG. 18, one or more second gusset plates 420 are positioned between and rigidly connected to the first gusset plates 400 and the horizontal cylinders 18 as generally shown. In the example, second gusset plates 420 preferably have a plurality of similar apertures 425 to permit a restricted flow of fluid to deter sloshing of the fluid inside the auxiliary storage chamber 302. The first and second gusset plates 400, 420 provide both structure reinforcement and deter sloshing of fluid inside the auxiliary storage chamber 302. Other gussets, reinforcement plates and sloshing deterring structures known by those skilled in the field may be used. For example, as seen in FIG. 19, the second gusset plates 420 are used without the first gusset plates 400. In this example, the second gusset plates 420 are rigidly connected to the four adjacent horizontal cylinder walls 18 and further include a third gusset plate 430 which is generally shown in a horizontal position between the generally vertically-oriented second gusset plates 420.

Figure 8:
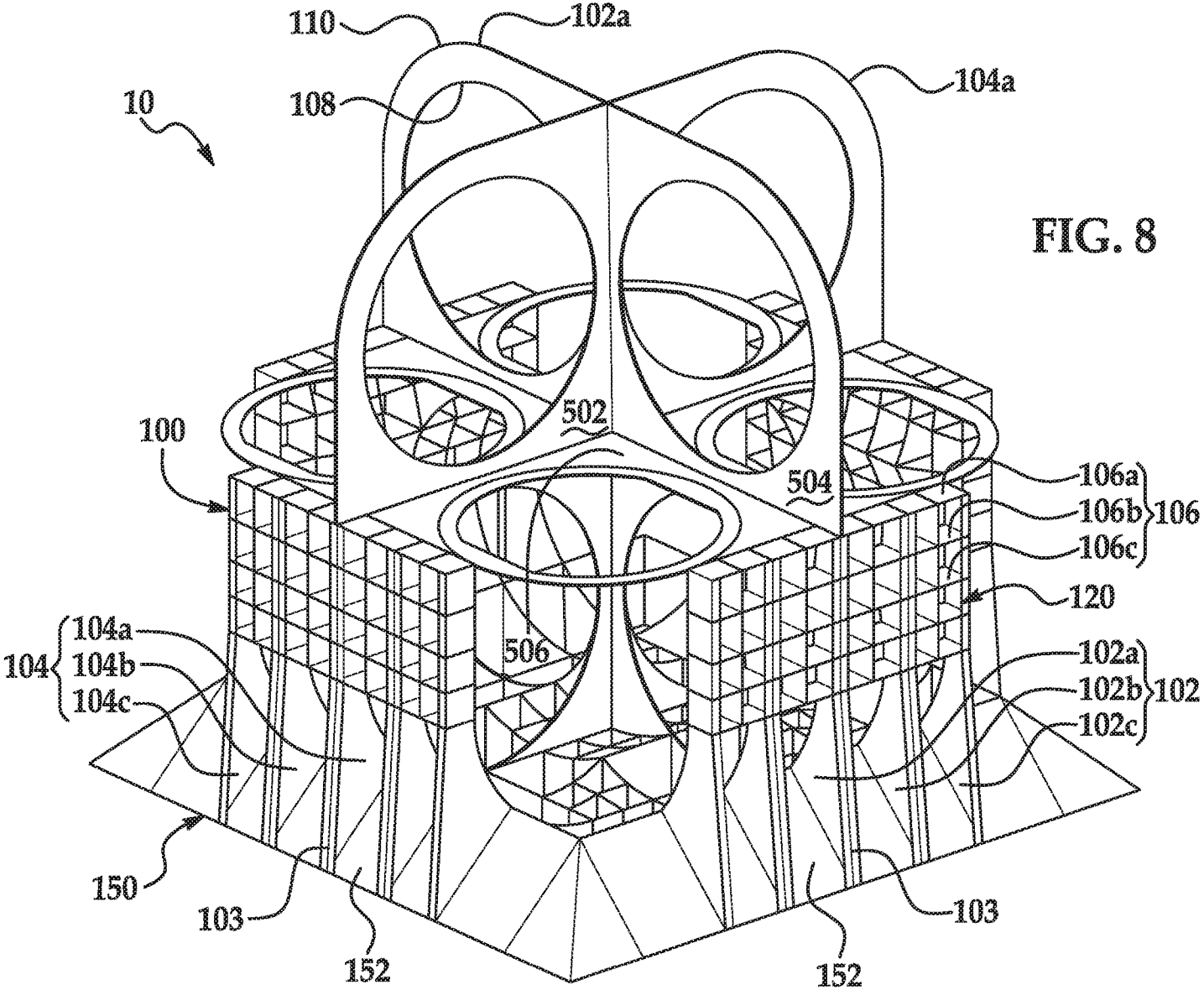
FIG. 8 is a perspective view of the storage tank containment of FIG. 1 similar to FIG. 7 without showing the storage tank and bulkheads.

As further seen in FIGS. 7 and 8, gusset plates 502 and 504 can be positioned between and rigidly connected to vertically adjacent parallel horizontal cylinder walls 18 in the auxiliary storage chamber 302, while a gusset plate 506 is positioned between and rigidly connected to horizontally adjacent parallel vertical cylinder walls 16, in addition, the gusset plates 502, 504 and 506 are connected at their respective intersections. Each of the gusset plates 502, 504 and 506 extend in a plane passing through a center of the storage tank 12. The gusset plates 502 and 504 extend vertically in parallel with respective opposing side faces of the storage tank 12, and discontinue at an intersection with the walls 14, as well at an intersection with respective adjacent gusset plates. The gusset plate 506 extends horizontally in parallel with opposing top and bottom faces of the storage tank 12, and also discontinues at an intersection with the walls 14, as well as at an intersection with respective adjacent gusset plates. Only three gusset plates 502, 504 and 506 out of eight total gusset plates are indicated and described for clarity. It can be seen and understood that the other of the gusset plates are positioned and configured similarly to the gusset plates 502, 504 and 506.

As shown, the gusset plates 502, 504 and 506 can be rigidly interconnected at their intersections, as well as interconnected with the support structure 100. As shown, the vertically disposed gusset plates 502 and 504 connect to the central vertical braces 104*a* and 102*a*, respectively, while the horizontally disposed gusset plate 506 connects to the horizontal brace 106*a*. The gusset plates 502, 504 and 506 can fluidly compartmentalize the auxiliary storage chamber 302, or as explained above, may include one or more apertures (not shown in this example) to permit a flow of fluid.

Figure 13:
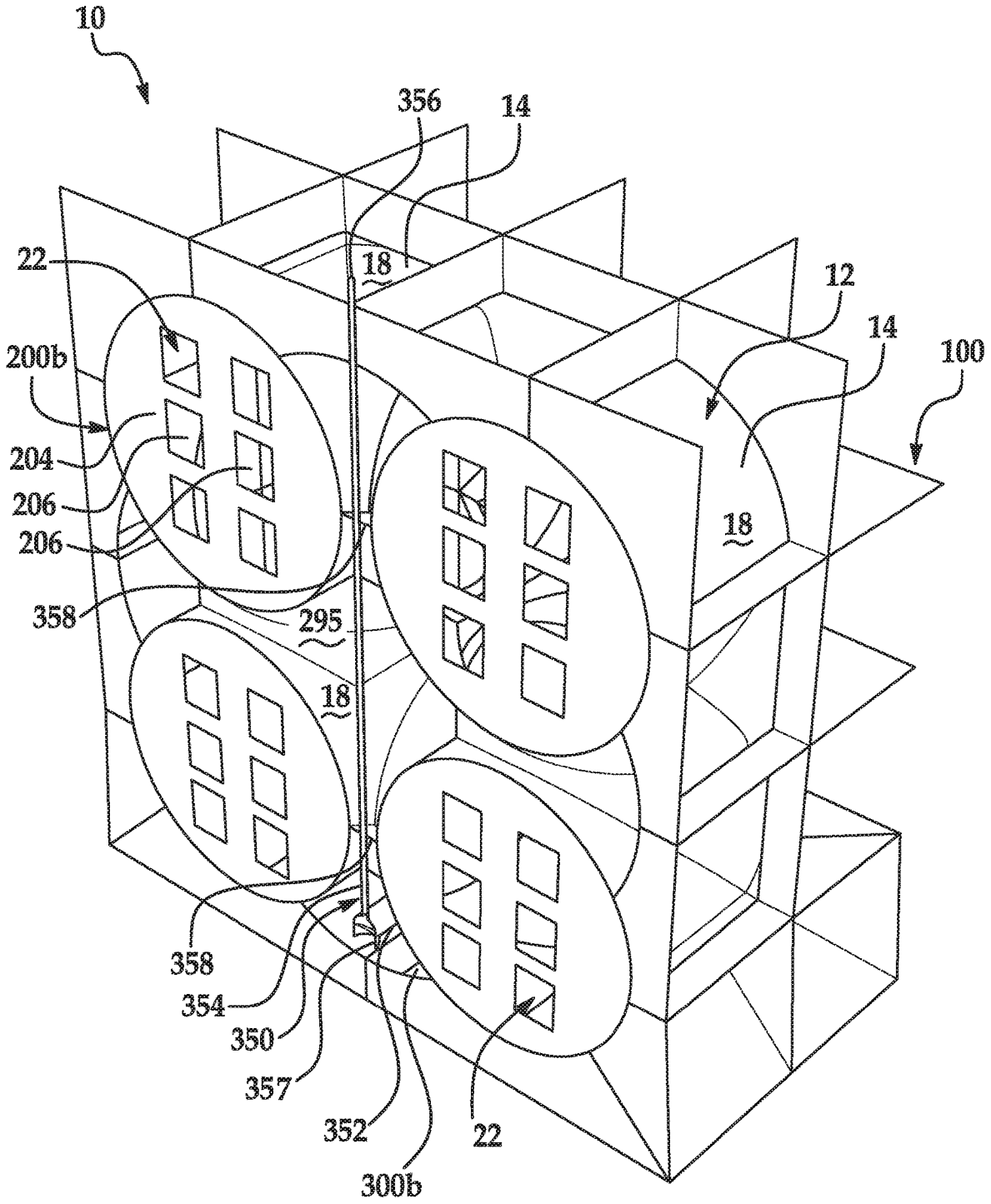
FIG. 13 is a cut-away perspective view of the storage tank system in FIG. 5 showing alternate examples of bulkheads positioned in the horizontal cylinder walls of the storage tank.
Figure 14:
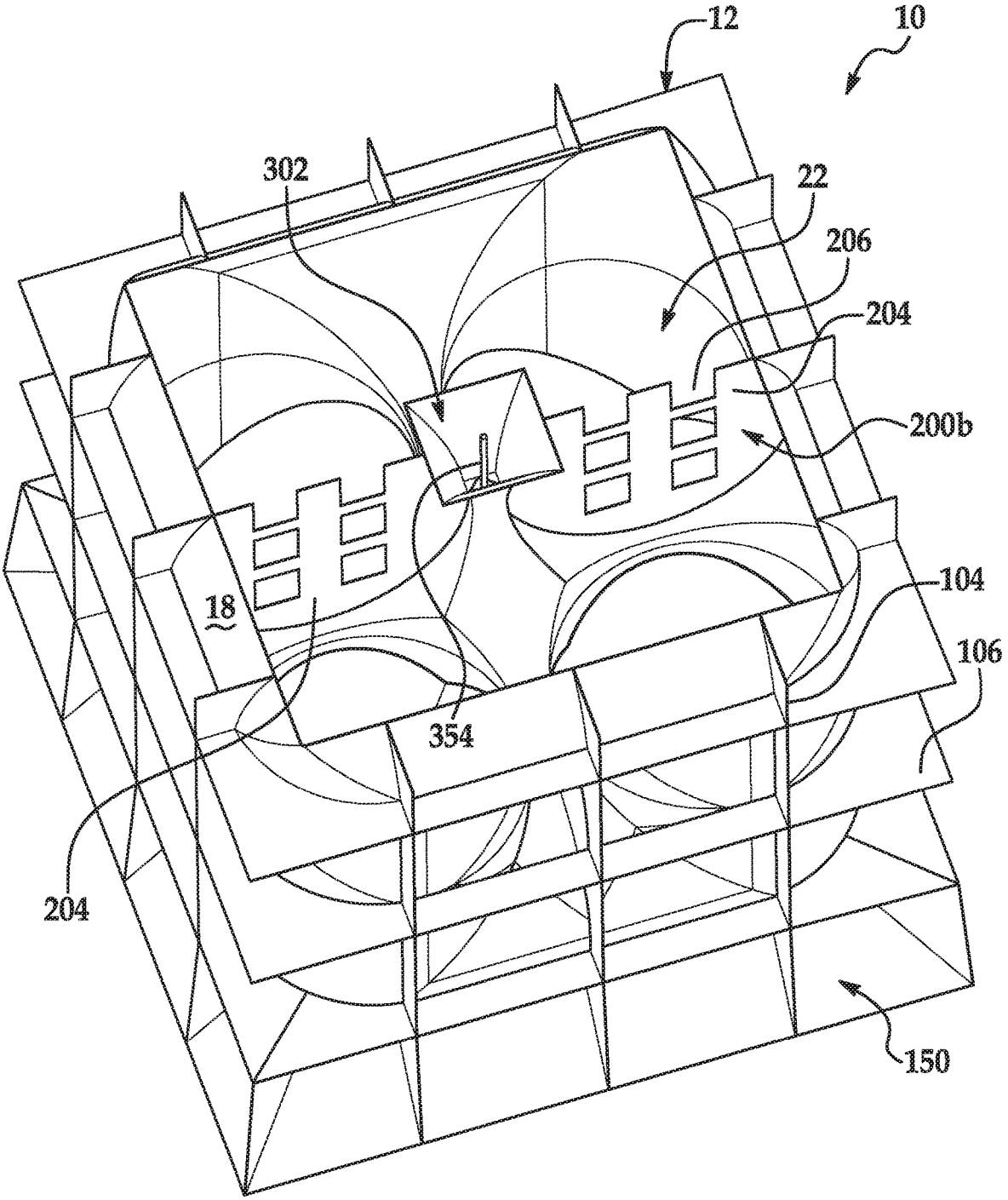
FIG. 14 is an alternate cut-away perspective view of the storage tank containment system in FIG. 11 showing the bulkheads positioned in the horizontal cylinder walls of the storage tank.

Referring to FIGS. 13, 14, and 15, one example of a device for filling and extracting fluid from the tank 12 is in the form of a filling tower 350. In this example, filling tower 350 includes a substantially horizontal hollow tube 352 connected to a substantially vertical hollow tube 354. The vertical tube 354 includes an intake port 356 positioned near the top of the storage tank 12, or extending therefrom. The intake port 356 is configured to connect to a remote fluid source, such as a transfer pump (not shown) or other devices known by those skilled in the art. The vertical tube 354 also includes an outlet port 357 positioned near the bottom of the storage tank 12. The horizontal hollow tube 352 can connect both to the vertical tube 354 at the location of the outlet port 357, and, as shown in FIG. 15, to and through one or more of the cylinder horizontal walls 18 to provide fluid communication between the intake port 356 and the interior fluid storage chamber 22.

As best shown in FIG. 13, the vertical hollow tube 354 is supported by a plurality of support brackets or structures 358 which preferably permit fluid communication on either side of the support structures 358. The vertical tube 354 and the support structures 358 are located along a passageway formed in a central portion of the bulkhead structure 200*b* in the space between the planar plates 204. The vertical tube 354 can include one or more additional ports (not shown) to provide fluid communication between the intake port 356 and the auxiliary storage chamber 302. Alternatively, through ports (not shown) may be used through the interior portions of cylinder walls 16*b* and/or 18*b* to ease the flow of fluid into and out of the tank 12.

The filling tower 350 can also be used to extract a fluid from the interior fluid storage chamber 22 and the auxiliary storage chamber 302. To optimize extraction, the outlet port 357 can be located in near proximity to an interior surface of the bottommost closure plate 300*b* when the tank 12 is in an installed position. The closure plate 300*b* can be shaped to leverage gravity when extracting fluid from the auxiliary storage chamber 302. As shown in FIG. 13, the outlet port 357 is positioned at the lowest point of the auxiliary storage chamber 302 just above the inflection point on the surface of the curved closure plate 300*b*, allowing all fluid within the tank 12 to be extracted from the auxiliary storage chamber 302, and in turn from the interconnected interior fluid storage chamber 22. It is understood that other tubes, pipes or ports may be used to permit the rapid, high volume flow of fluid into and out of the tank 12 to facilitate filling and extracting the fluid.

Figure 20:
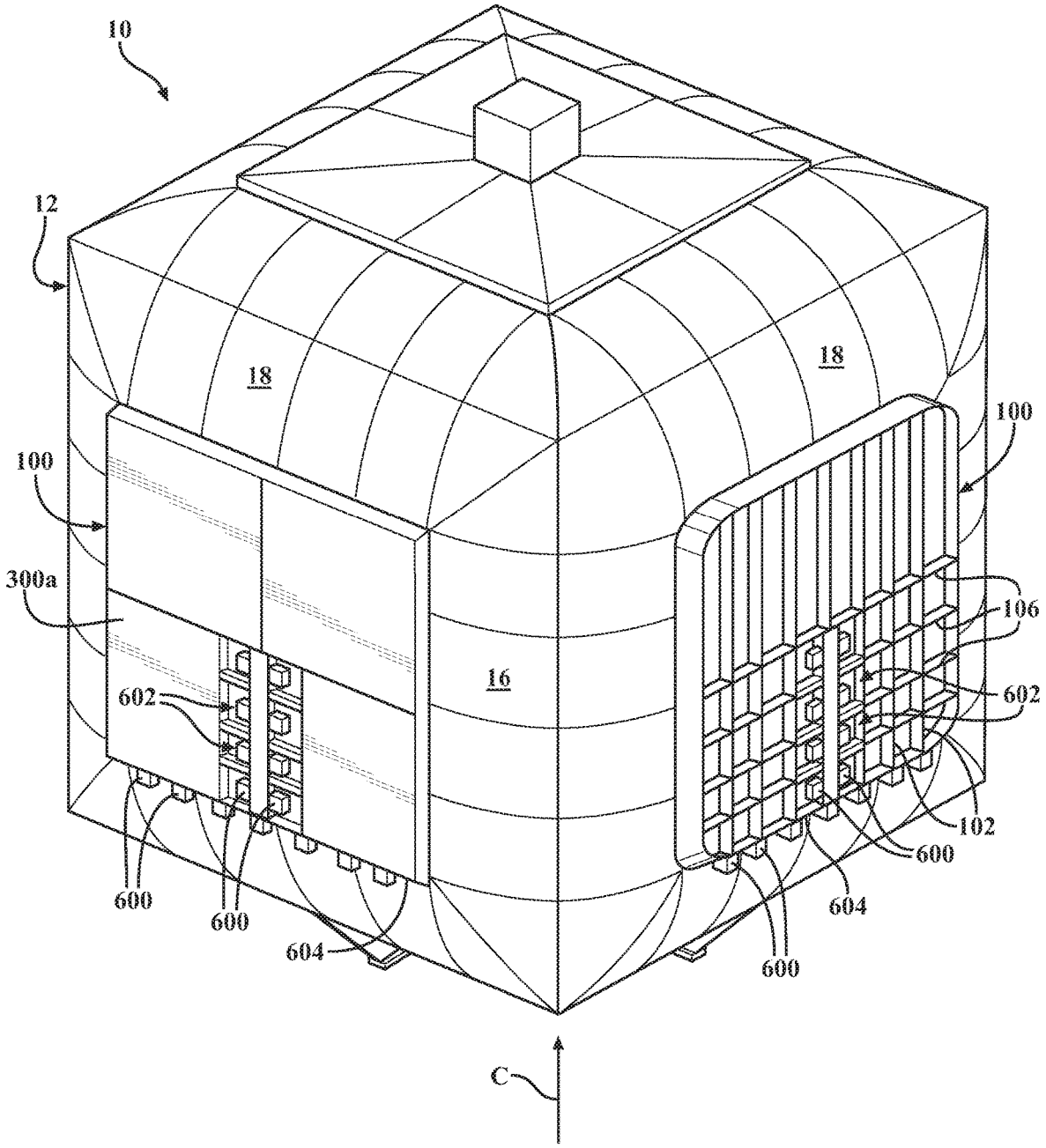
FIG. 20 is a perspective view of a third example of a storage tank containment system showing the storage tank and an alternate storage tank support and closure plate structure.

Referring to FIGS. 20-23, a third example of a storage tank containment system 10 is shown. FIG. 20 is a perspective view showing the storage tank 12 and a pair of exterior support structures 100 on two of the sides of the storage tank 12. The exterior support structures 100 extend between exterior surfaces of the rigid cylinder walls 16, 18 and reinforce the storage tank 12 against dynamic loading from fluid in the interior fluid storage chamber 22. One of the exterior support structures 100 in FIG. 20 is shown as including a plurality of interconnected braces 102, 106 forming a reinforcing lattice structure.

The other exterior support structure 100 in FIG. 20 is shown as covered by a generally planar closure plate 300*a* extending at least partially across an exterior surface of one of the exterior support structures 100. It is understood that both of the exterior support structures 100 in FIG. 20 can include a lattice structure of interconnected braces 102, 106 and can be covered by closure plates 300*a* that extend at least partially over the exterior surfaces of each of the exterior support structures 100.

Interior surfaces of the closure plates 300*a*, interior surfaces of the exterior support structures 100, and exterior surfaces of the plurality of rigid cylinder walls 16, 18 can be used to define an auxiliary storage chamber 302 similar to that described in reference to FIGS. 1-19. By locating closure plates 300*a* external to the exterior support structures 100 and external to exterior surfaces of the rigid cylinder walls 16, 18, the volume of the auxiliary storage chamber 302 can be greatly increased. The design of the filling tower 350 can also be simplified, as described in reference to FIG. 23.

The exterior support structures 100 in FIG. 20 also include a plurality of blocks 600. Some of the blocks 600 are disposed within openings 602, each opening 602 defined by the intersection of four of the rigidly interconnected braces 102, 106 in each of the lattice structures. The blocks 600 disposed within the openings 602 are configured to maintain the storage tank 12 in an installation position when abutting brackets extending from a cargo hold of a carrier as further described in reference to FIG. 23. The blocks 600 can be formed of marine-grade, laminated, densified wood and adhesively bonded to the braces 102, 106 using, for example, epoxy. Other high-strength materials can also be used for the blocks 600.

Some of the blocks 600 are also disposed on support surfaces 604 of the exterior support structures 100, the support surfaces 604 extending from the exterior surface of one of the bottommost rigid cylinder walls 18 when the storage tank 12 is in an installation position within a cargo hold of a carrier to the respective closure plate 300*a* covering the respective exterior support structure 100. The support surfaces 604 and coupled blocks 600 are configured to abut ledges extending from a cargo hold in a carrier to maintain the storage tank in the installation position as further described in reference to FIG. 23.

Figure 21:
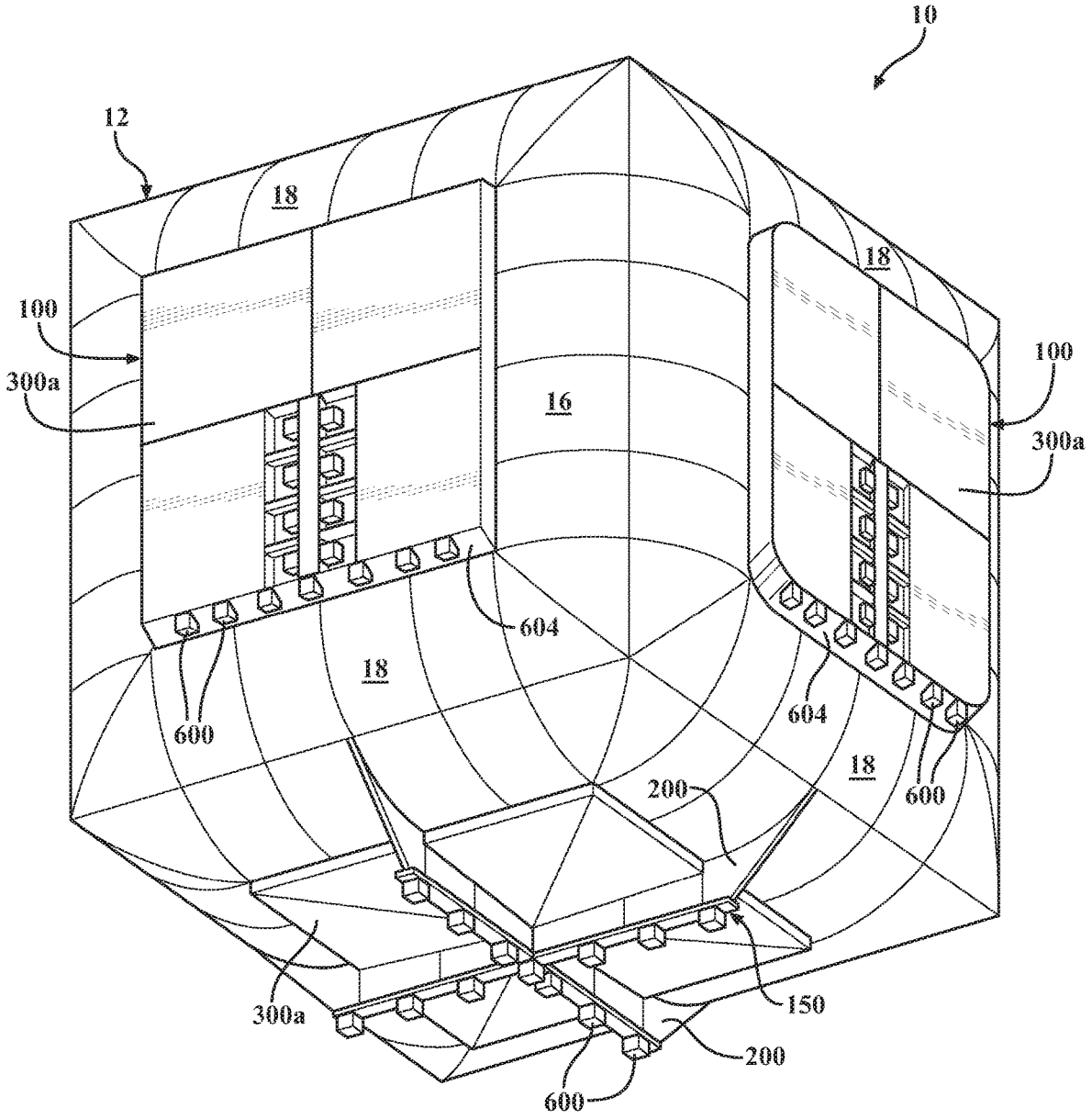
FIG. 21 is a perspective view of the bottom side of the storage tank containment system of FIG. 20 as viewed from the direction of C in FIG. 20.

FIG. 21 is a perspective view of the bottom side of the storage tank containment system 10 of FIG. 20 as viewed from the direction of C in FIG. 20. Here, both of the exterior support structures 100 are substantially covered by closure plates 300*a* extending across exterior surfaces of the exterior support structures 100 as was described in FIG. 20. The tank 12 also includes a closure plate 300*a* extending between exterior surfaces of the bottommost rigid cylinder walls 18 and a plurality of bulkheads 200, with each bulkhead 200 extending through opposing horizontal rigid cylinder walls 18 and across the interior fluid chamber 22 in an orientation transverse to longitudinal axes of opposing horizontal rigid cylinder walls 18.

Further, each bulkhead 200 extends outward from the exterior surfaces of the opposing horizontal rigid cylinder walls 18 between sections of the bottommost closure plate 300*a* to form a base 150 for the storage tank. The base 150 of the storage tank 12 is configured to support the storage tank 12 in an installation position within a cargo hold of a carrier. In the example of FIG. 21, two bulkheads 200 extend centrally through opposing horizontal rigid cylinder walls 18 and intersect at a center of the bottommost side of the storage tank 12, forming a cross-shape for the base 150, though other shapes, intersections, and numbers of bulkheads 200 are also possible. A plurality of blocks 600 can also be disposed along the base 150 in order to position and thermally insulate the tank 12 within a cargo hold of a carrier.

Figure 22:
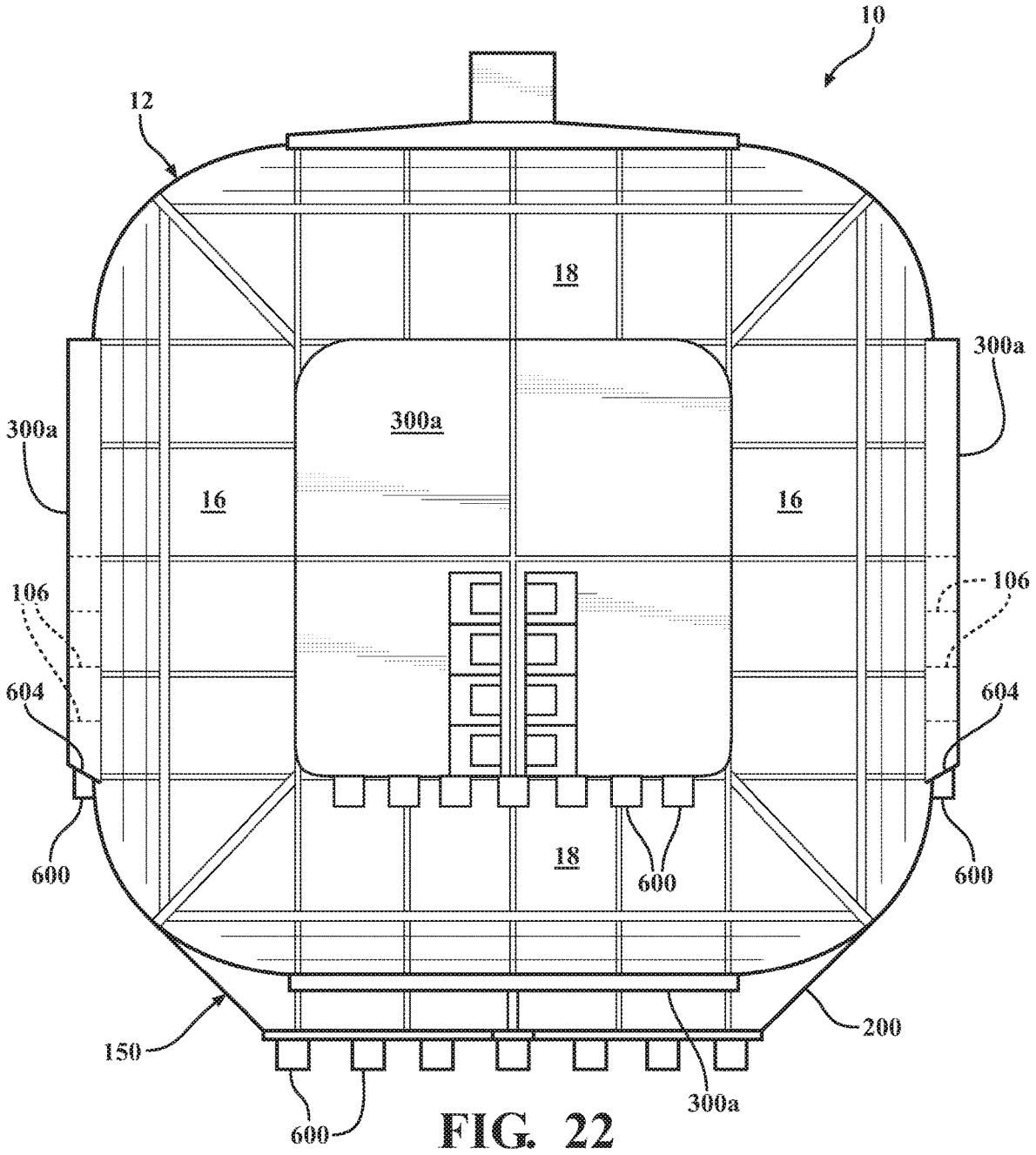
FIG. 22 is a side view of the storage tank containment system of FIG. 20.

FIG. 22 is a side view of the storage tank containment system 10 of FIG. 20. Two support surfaces 604 are shown as extending from the exterior surfaces of opposing bottommost rigid cylinder walls 18 to respective closure plates 300*a*. By including support surfaces 604 extending from opposing rigid cylinder walls 18, the storage tank 12 can be restrained against either pitch or roll of the carrier when in the installation position. The support surfaces 604 are shown as extending angularly between 15 and 60 degrees above a horizontal plane extending through the longitudinal axes of the horizontal rigid cylinder walls 18 forming the bottommost side of the storage tank 12 when the storage tank 12 is in the installation position.

Figure 23:
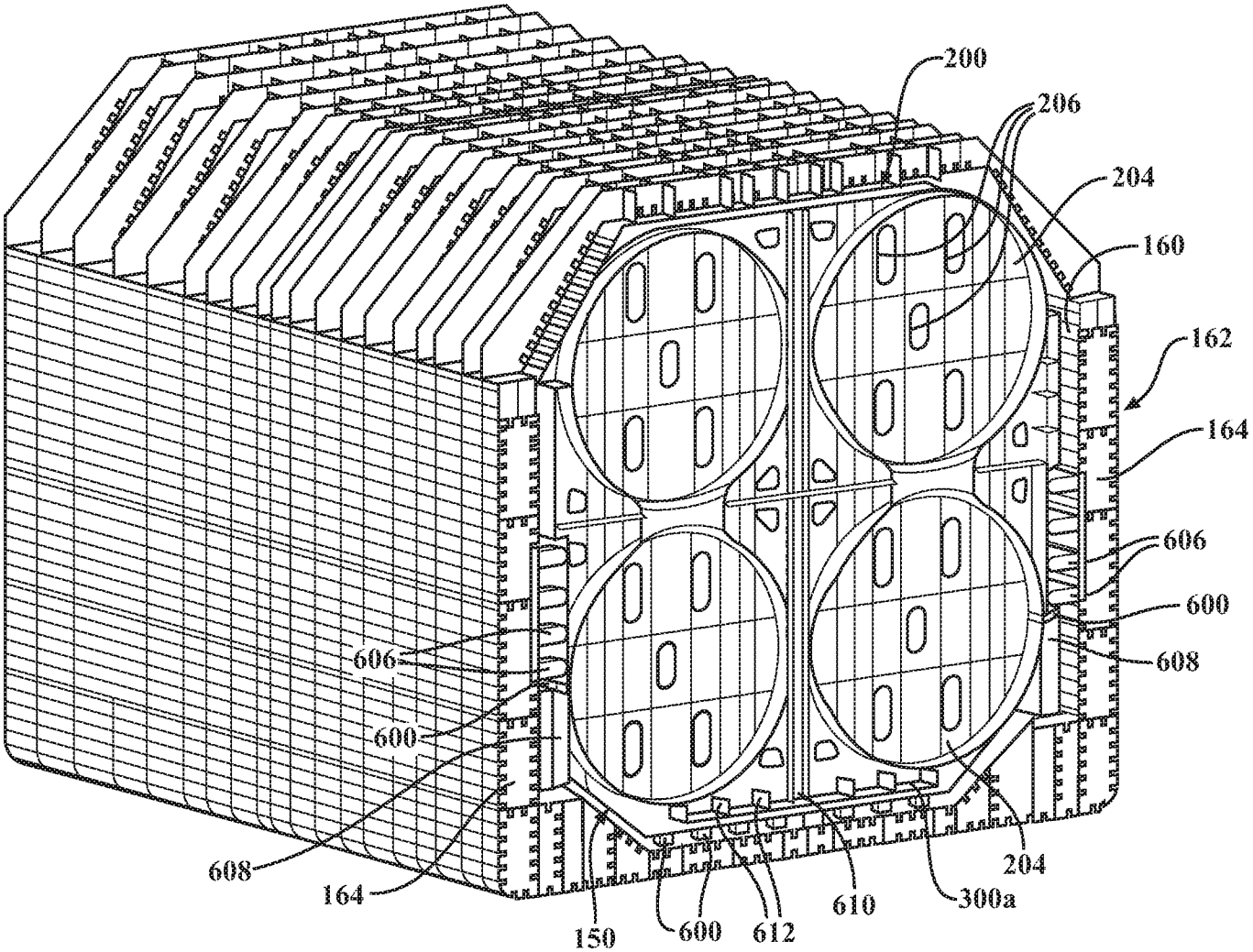
FIG. 23 is a sectional view of the storage tank containment system of FIG. 20 shown in an installation position within a cargo hold of a carrier.

In one non-limiting example, the support surfaces 604 can be angled between 25 and 40 degrees above the horizontal plane, in order to optimize support for the storage tank 12. For example, angled support surfaces 604 can rest on a ledge extending from the cargo hold as shown in FIG. 23 and at the same time can allow for expansion and contraction of the cargo hold. By angling the support surfaces 604, any changes in build tolerance or wall position of both the storage tank 12 and the cargo hold will not adversely affect the ability of the storage tank 12 to be held in the installation position.

FIG. 23 is a cutaway perspective view of the storage tank containment system 10 of FIG. 20 shown in an installation position within a cargo hold 160 of a marine carrier 162. Blocks 600 within the openings 602 formed by the interconnected braces 102, 106 of the side exterior support structures 100 are engaged by brackets 606 extending from the upright walls 164 defining the sides of the cargo hold 160. The brackets 606 can be configured to clamp the blocks 600 within adjacent openings 602 in order to inhibit movement of the tank 12 with respect to the cargo hold 160 in the event, e.g., of a rolling or pitching motion of the carrier 162.

Additional blocks 600 can extend from the base 150 and from the support surfaces 604 on the lower side of opposing exterior support structures 100 in order to rest, respectively, on a bottom surface and a skirt or ledge 608 extending from the upright walls 164 of the cargo hold 160. The ledge 608 can be configured to support the weight of the tank 12 in the carrier 162 when the tank 12 is in an installation position. By angling the support surfaces 604, and optionally the blocks 600 extending from the support surfaces 604, any variations in dimension of the cargo hold 160 can be accounted for in the design of the tank 12. This is important given the temperature differential between the tank 12 and the carrier 162 as well as the vast size of the tank 12 and the cargo hold 160.

A single bulkhead 200 is also shown in FIG. 23 as including a plurality of substantially planar plates 204 configured to span cross-sections of the horizontal walls 18 defining a portion of the interior fluid storage chamber 22. Each planar plate 204 defines a plurality of ovoid apertures 206 arranged in an "x" pattern about the plate 204 to permit fluid communication on either side of the plate 204. A passageway 610 is also present in a central portion of the bulkhead 200 in the space between the planar plates 204. The passageway 610 is sized sufficiently to allow the filling tower 350 to extend through the tank 12.

In the third example of FIG. 23, a closure plate 300*a* is shown as extending between and below the bottommost horizontal rigid cylinder walls 18. A plurality of vanes 612 extend along the interior surface of the closure plate 300*a* to ease the sloshing or dynamic movement of the fluid within the auxiliary storage chamber 302. Given the location of the closure plate 300*a* below the bottommost horizontal rigid cylinder walls 18, only the vertical hollow tube 354 described in FIGS. 13-15 would be required for the filling tower 350 instead of the combination of a the vertical hollow tube 354 and the horizontal hollow tube 352 since the horizontal rigid cylinder walls 18 could be designed with apertures to allow fluid to enter the auxiliary storage chamber 302.

Figure 24:
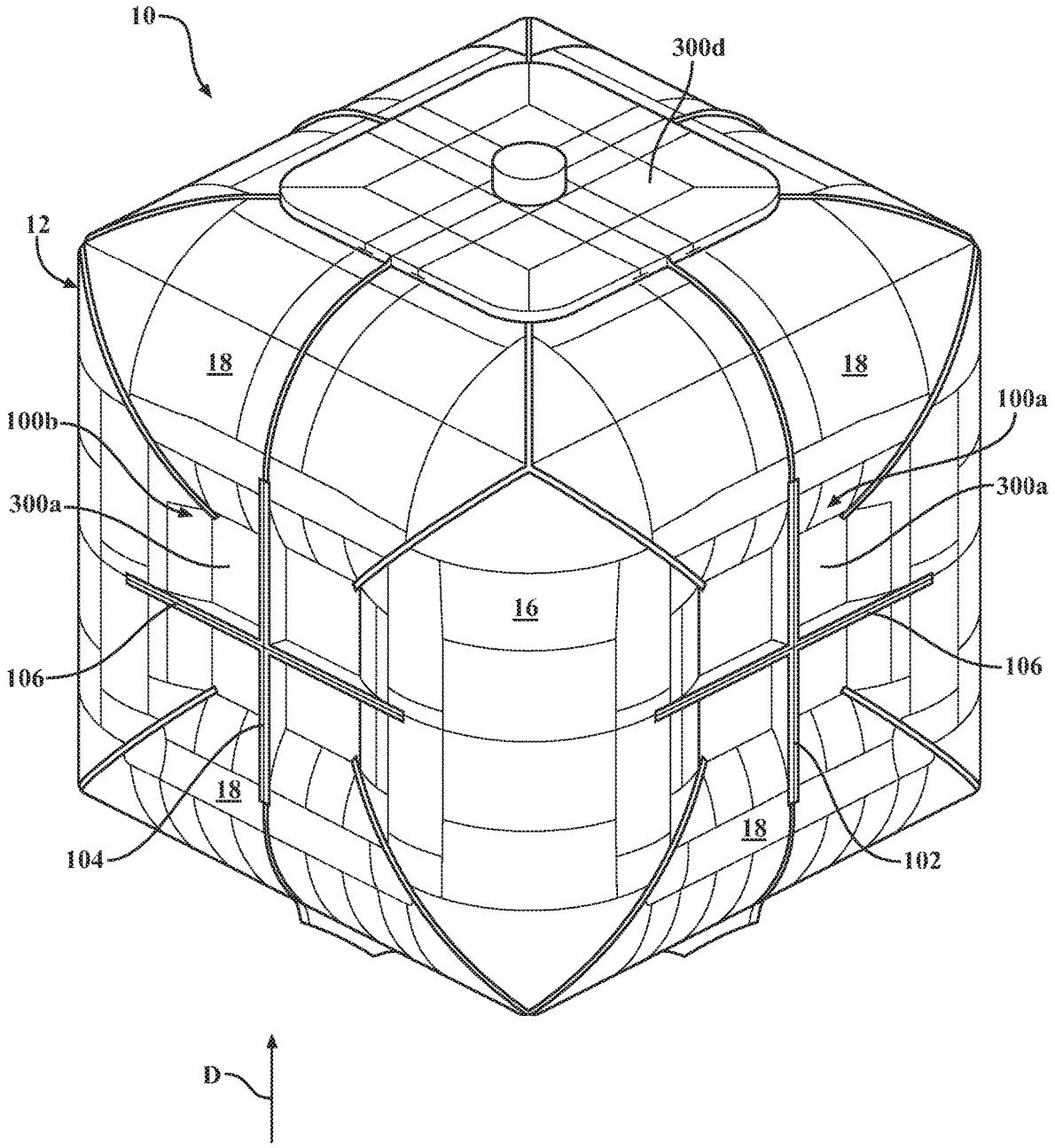
FIG. 24 is a perspective view of a fourth example of a storage tank containment system showing the storage tank and a storage tank closure plate structure.

Referring to FIGS. 24-27, a fourth example of a storage tank containment system 10 is shown. FIG. 24 is a perspective view showing a storage tank 12, closure plates 300*a*, 300*d*, and exterior support structures 100*a*, 100*b* that extend through the closure plates 300*a* and between exterior surfaces of successive interconnected rigid cylinder walls 16, 18 on two of the vertical sides of the storage tank 12 to reinforce the storage tank 12 against dynamic loading from fluid in the interior fluid storage chamber (not shown).

The storage tank 12 in this fourth example includes rigid tubular walls 16, 18 having opposing ends and intermediate segments with closed tubular cross-sections that are interconnected at both ends with respective ends of two other rigid tubular walls 16,18 such that interconnected interiors of the rigid tubular walls 16, 18 define an interior fluid storage chamber (not shown). The storage tank 12 also includes closure plates 300*a*, 300*d* connected between exterior surfaces of successive interconnected rigid tubular walls 16, 18 to define sides of the storage tank 12. Interior surfaces of the closure plates 300*a*, 300*d* and the exterior surfaces of the rigid tubular walls 16, 18 at least partially define an auxiliary fluid storage chamber (not shown similar to those described in reference to FIGS. 1-23.

Two types of closure plates 300*a*, 300*d* are shown in FIG. 24. The closure plate 300*a* extends normally between the exteriors of successive interconnected rigid tubular walls 16, 18 on each of the vertical sides of the storage tank 12. Contrastingly, the closure plate 300*d* extends tangentially between the exteriors of the successive interconnected tubular walls 16, 18 on a topmost side of the storage tank 12. Each of the sides of the storage tank 12 can be described as having a maximum outer dimension for the successive interconnected rigid tubular walls 16, 18 in reference to a center of the storage tank 12.

In the case of the vertical sides shown in FIG. 24, the maximum outer dimension is located at an outer perimeter of the rigid tubular walls 16, 18, and the closure plate 300*a* extends between the exteriors of the successive interconnected rigid tubular walls 16, 18 at a location interior to the maximum outer dimension. In other words, the closure plate 300*a* is recessed when compared to the maximum outer dimension on the vertical sides of the storage tank 12. This is beneficial in restricting the overall width of the storage tank 12 so as to better fit the storage tank 12 within a cargo hold of a carrier.

In the case of the topmost side, the closure plate 300*d* extends between the exteriors of the successive interconnected rigid tubular walls 16, 18 at a location exterior to the maximum outer dimension. In other words, the closure plate 300*d* is spaced slightly outward of the maximum outer dimension on the topmost side of the storage tank 12. Often, the overall height of a cargo hold can be greater than its width, allowing more leeway in the location of the closure plate 300*d*. Both of the closure plates 300*a*, 300*d* are shown as having planar or flat exterior surfaces, though other shapes are possible. For example, spherical, rounded, triangular, or 1-shaped closure plates could be used to form the outer limits of the auxiliary storage chamber.

Two exterior support structure 100*a* and 100*b* are shown in FIG. 24. Both have a cross-like shape with the exterior support structure 100*a* located on a right vertical side of the storage tank 12 and the exterior support structure 100*b* located on a left vertical side of the storage tank 12. The exterior support structure 100*a* includes rigidly interconnected vertical brace 102 and horizontal brace 106 extending between the exterior surfaces of the successive interconnected rigid tubular walls 16, 18 and through the closure plate 300*a* on the right vertical side of the storage tank 12. The exterior support structure 100*b* includes rigidly interconnected vertical brace 104 and the horizontal brace 106 extending between the exterior surfaces of the successive interconnected rigid tubular walls 16, 18 and through the closure plate 300*a* on the left vertical side of the storage tank 12.

The exterior support structures 100*a*, 100*b* not only extend through the closure plates 300*a* but also extend in an outward direction from exterior surfaces of the closure plates 300*a*, the outward direction being in reference to a center of the storage tank 12. Thus, the exterior support structures 100*a*, 100*b* are configured to reinforce the storage tank 12 against dynamic loading from fluid in the interior fluid storage chamber and provide surfaces useful for mounting and location restriction of the storage tank 12 as further described in reference to FIG. 25.

Figure 25:
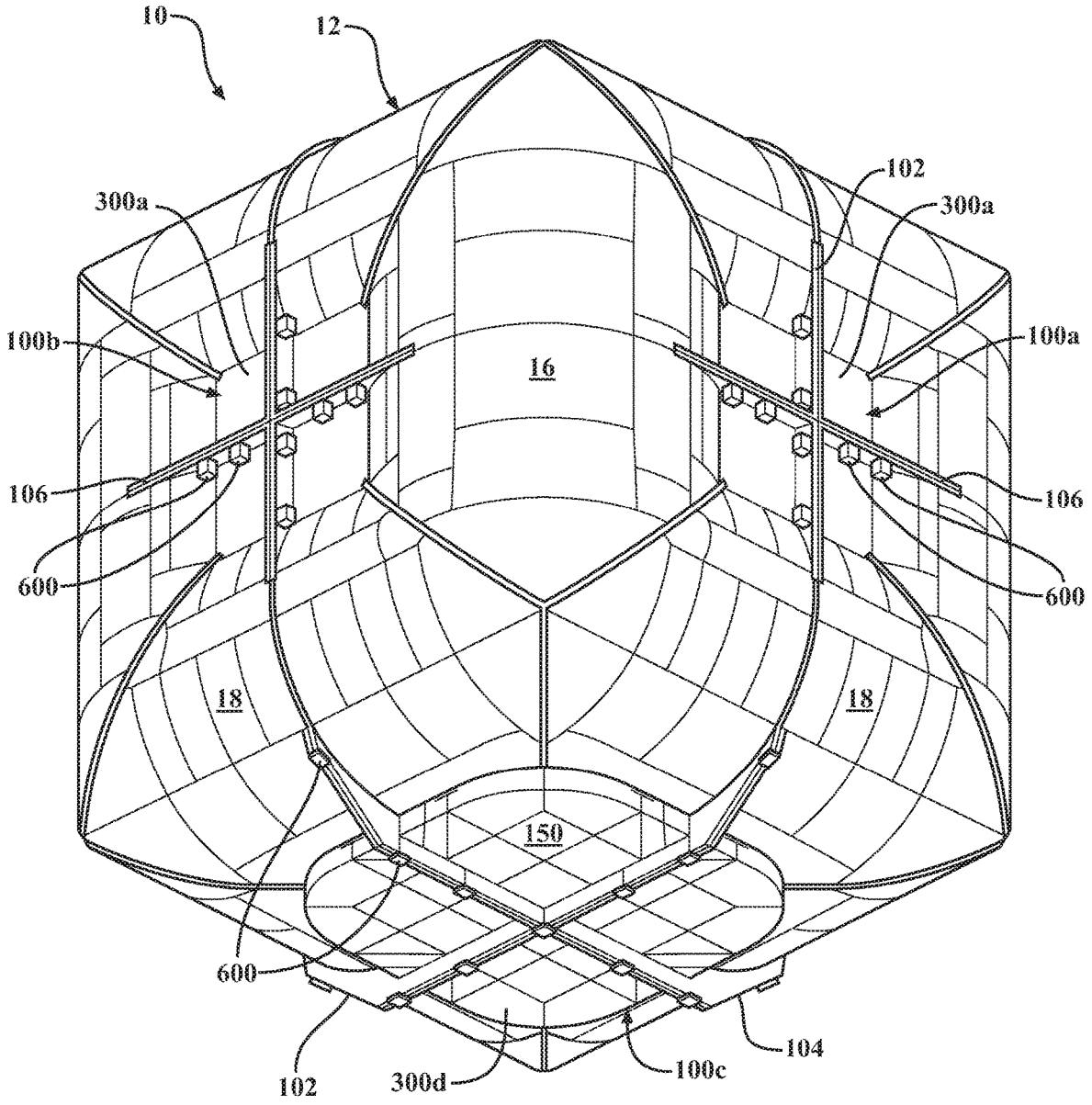
FIG. 25 is a perspective view of the bottom side of the storage tank containment system of FIG. 24 including storage tank support structures as viewed from the direction of D in FIG. 24.

FIG. 25 is a perspective view of the bottommost side of the storage tank containment system 10 of FIG. 24 including exterior support structures 100*a*, 100*b*, 100*c* as viewed from the direction of D in FIG. 24. The exterior support structure 100*c* on a bottommost side of the storage tank 12 includes the vertical braces 102, 104 extending outward from the exterior surfaces of the successive interconnected rigid tubular walls 16, 18 and outward from an exterior surface of the closure plate 300*d* to form a base 150 for the storage tank. The base 150 is configured to support the storage tank 12 in an installation position within a cargo hold of a carrier. Here, peripheries of the vertical braces 102, 104 forming the base 150 are chamfered to match the interior shape of a cargo hold, though other types of shaping of the vertical braces 102, 104 is possible.

FIG. 25 also shows a plurality of blocks 600. The blocks 600 are disposed on the exterior support structures 100*a*, 100*b*, 100*c* in various manners. For example, the blocks 600 associated with the exterior support structures 100*a*, 100*b* are disposed in contact with one of vertical braces 102, 104 or the horizontal brace 106 and the exterior surface of the closure plate 300*a* in an abutment relationship. The blocks 600 disposed, for example, below and in contact with the horizontal brace 106 can provide a vertical support surface and the blocks 600 disposed on the sides and in contact with the vertical braces 102, 104 can provide roll and pitch restriction surfaces. The blocks 600 associated with the base 150 of the storage tank 12 can be disposed in contact with outer surfaces of the vertical braces 102, 104 as shown in order to space the storage tank 12 from the floor of a carrier.

The blocks 600 are positioned in a manner configured to maintain the storage tank 12 in an installation position when serving as spacers or when abutting brackets, stops, or other structures extending from a cargo hold of a carrier. The blocks 600 can be formed of marine-grade, laminated, densified wood and adhesively bonded to the closure plates 300*a*, 300*d* and the braces 102, 104, 106 using, for example, epoxy. Other high-strength materials can also be used for the blocks 600. Though the blocks 600 in FIG. 25 are shown as equally spaced along the various braces 102, 104, 106, other configurations are possible. For example, the blocks 600 can be clustered in certain areas or designed to wrap around the braces 102, 104, 106. Though the blocks 600 in FIG. 25 are shown as cubic, other shapes for the blocks 600 are also possible, such as elongated rectangular, triangular, or other shapes.

Figure 26:
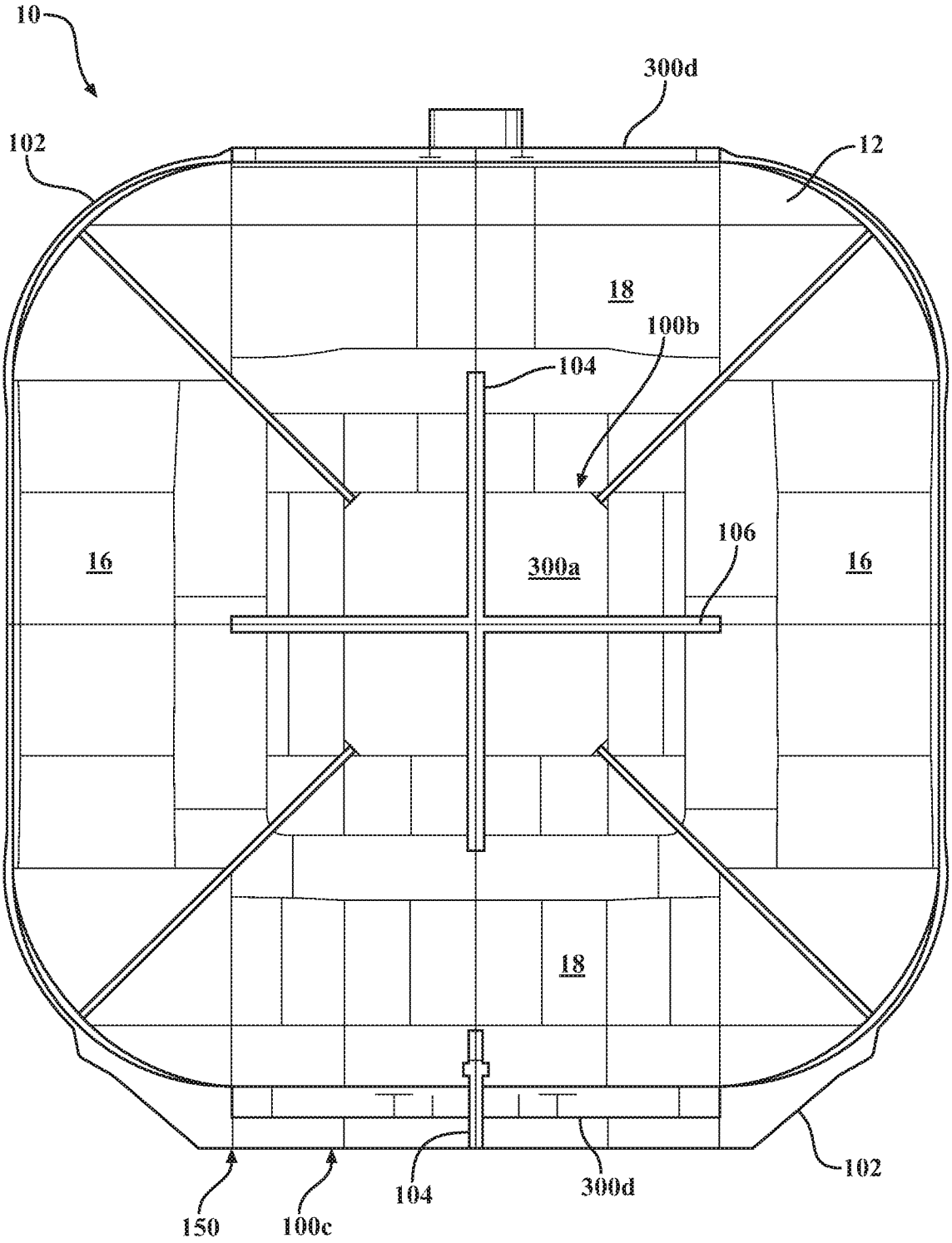
FIG. 26 is a side view of the storage tank containment system of FIG. 24.

FIG. 26 is a side view of the storage tank containment system 10 of FIGS. 24 and 25. In this view, the storage tank 12 is shown as generally circumscribed by the vertical brace 102 and partially bisected by the vertical brace 104 and the horizontal brace 106 that form the external support structure 100. The vertical brace 104 and the horizontal brace 106 are shown as intersecting with a cross-like or lattice-like shape. The vertical brace 104 and the horizontal brace 106 also intersect with and extend through the rigid tubular walls 16, 18. Though shown as extending through surfaces, any of the braces 102, 104, 106 can alternatively be designed to abut exterior surfaces of the rigid tubular walls 16, 18 and the closure plates 300*a*, 300*d* and still provide support and rigidity to the storage tank containment system 10.

The closure plates 300*d* extending along the topmost side and the bottommost side of the storage tank 12 both extend outward or beyond a maximum outer dimension for the successive interconnected rigid tubular walls 16, 18 on the topmost side and the bottommost side. The closure plate 300*d* on the topmost side of the storage tank 12 has a shorter height than the closure plate 300*d* on the bottommost side of the storage tank 12, though the heights could be equal or opposite in value depending on the position and structure of the auxiliary fluid storage chamber. The volume of the auxiliary fluid storage chamber is tied to the placement of the closure plates 300*d*, and the greater the height of the closure plates 300*d*, the greater the volume of the auxiliary fluid storage chamber.

Figure 27:
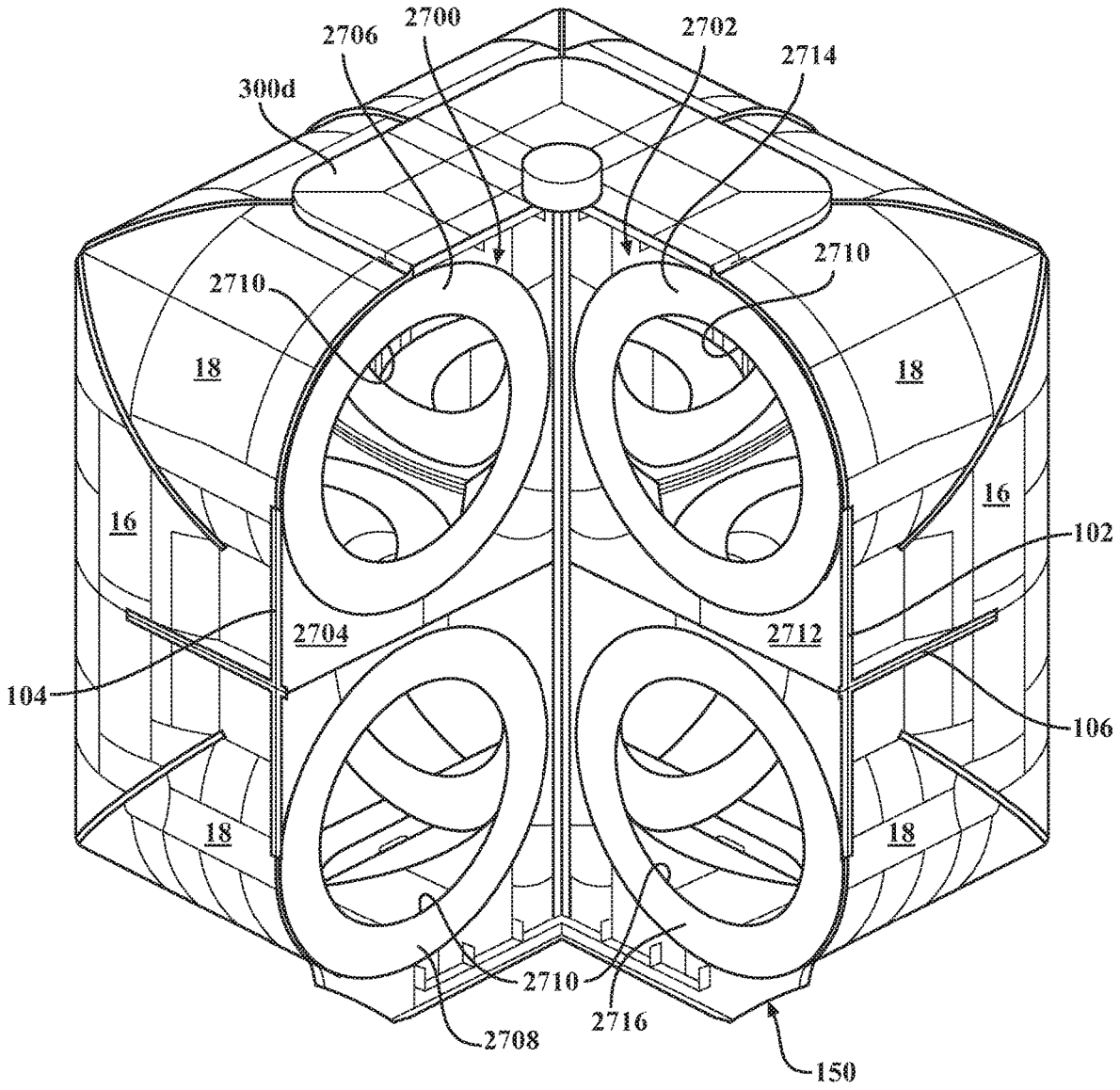
FIG. 27 is a cut-away perspective view of the storage tank containment system of FIG. 24 showing alternate examples of bulkhead ring webs positioned in horizontal walls.

FIG. 27 is a cut-away perspective view of the storage tank containment system 10 of FIGS. 24-26 showing examples of bulkhead ring webs 2700, 2702 positioned across intermediate segments of the horizontal rigid tubular walls 18 of the storage tank 12. The bulkhead ring web 2700 includes a gusset plate 2704 that extends along the same plane as the vertical brace 104 and planar plates 2706, 2708 having an annular shape that extend through or are otherwise connected with interiors of the rigid tubular walls 18. The planar plates 2706, 2708 define large apertures 2710 that permit a restricted flow of fluid through the bulkhead ring web 2700. The bulkhead ring web 2702 also includes a gusset plate 2712 that extends along the same plane as the vertical brace 102 and two planar, annular-shaped plates 2714, 2716 defining apertures 2710. Both the planar plates 2706, 2708, 2714, 2716 and the apertures 2710 have an annular shape.

The apertures 2710 within the planar plates 2706, 2708, 2714, 2716 are sized such that interior edges of the planar plates 2706, 2708, 2714, 2716 extend above minimum fill levels in order to attenuate sloshing loads within the storage tank 12. The annular planar plates 2706, 2708, 2714, 2716 can be used in the place of flexible membrane-type bulkheads. Alternatively, inner membranes with additional apertures (not shown) can be mounted within the existing apertures 2710 of the planar plates 2706, 2708, 2714, 2716. By using ring-shaped planar plates 2706, 2708, 2714, 2716 in place of the smaller-aperture-style planar plates 204 of previously described embodiments, the overall weight of the storage tank 12 can be further reduced.

It will be understood that the above described embodiments, features and examples of the structures and features of the storage tank containment system 10 may be altered and/or combined in a wide variety of manners according to one or more design, strength, manufacturing, cost and/or other criteria. These dimensions described are based on a few contemplated design cases and are given as non-limiting examples. It will be understood that other thicknesses, depending on the material used and application, may be used.

While the invention has been described in connection with what is presently considered to be the most practical and preferred embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A storage tank, comprising:

rigid tubular walls having respective opposing ends and respective intermediate segments with closed tubular cross-sections extending from one of the ends to the other one of the ends, wherein each rigid tubular wall is interconnected at both ends with respective ends of two other rigid tubular walls such that interconnected interiors of the rigid tubular walls define an interior fluid storage chamber, the rigid tubular walls comprising:

a first set of rigid tubular walls extending parallel to one another, a second set of rigid tubular walls extending parallel to one another and orthogonal to the first set of rigid tubular walls, and a third set of rigid tubular walls extending parallel to one another and orthogonal to the first set of rigid tubular walls and the second set of rigid tubular walls; and bulkhead ring webs positioned in the interior fluid storage chamber across the intermediate segments of the rigid tubular walls.

2. The storage tank of claim 1, wherein the rigid tubular walls define a cube.

3. The storage tank of claim 1, wherein the rigid tubular walls define edges of a plurality of rectangles, at least one of the rectangles having a horizontal edge that is different in length from a vertical edge.

4. The storage tank of claim 1, wherein each rigid tubular wall of the first set of rigid tubular walls has a first length, wherein each rigid tubular wall of the second set of rigid tubular walls has a second length, the first length being different from the second length.

5. The storage tank of claim 4, the first set of rigid tubular walls comprising at least four rigid tubular walls, and the second set of rigid tubular walls comprising at least four rigid tubular walls.

6. The storage tank of claim 1, wherein each rigid tubular wall of the first set of rigid tubular walls has a first length, wherein each rigid tubular wall of the second set of rigid tubular walls has a second length, the first length being equal to the second length.

7. The storage tank of claim 1, wherein the bulkhead ring webs comprise:

a first set of bulkhead ring webs facing a first direction; and a second set of bulkhead ring webs facing a second direction, the first direction being orthogonal to the second direction.

8. The storage tank of claim 7, wherein a quantity of bulkhead ring webs in the first set of bulkhead ring webs is equal to a quantity of bulkhead ring webs in the second set of bulkhead ring webs.

9. The storage tank of claim 7, wherein a quantity of bulkhead ring webs in the first set of bulkhead ring webs is different from a quantity of bulkhead ring webs in the second set of bulkhead ring webs.

10. The storage tank of claim 1, further comprising:

closure plates connected between exterior surfaces of successive interconnected rigid tubular walls to define sides of the storage tank, wherein interior surfaces of the closure plates and the exterior surfaces of the rigid tubular walls define an auxiliary fluid storage chamber at a central portion of the storage tank.

11. The storage tank of claim 10, further comprising: exterior support structures extending through the closure plates and between the exterior surfaces of the successive interconnected rigid tubular walls on at least some of the sides of the storage tank.

12. The storage tank of claim 1, further comprising a plurality of end caps, each end cap being disposed at a respective intersection between respective rigid tubular walls.

13. The storage tank of claim 12, wherein at least one end cap defines a spherical shape.

14. The storage tank of claim 12, wherein at least one end cap defines an aspherical shape.

* * * * *